US011684227B2

(12) United States Patent
Glas et al.

(10) Patent No.: US 11,684,227 B2
(45) Date of Patent: Jun. 27, 2023

(54) SURFACE CLEANING APPARATUS HAVING A BRUSHROLL

(71) Applicant: BISSELL INC., Grand Rapids, MI (US)

(72) Inventors: Steven Glas, Middleville, MI (US); Gabriel Melching, Spring Lake, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/337,064

(22) Filed: Jun. 2, 2021

(65) Prior Publication Data

US 2022/0386836 A1 Dec. 8, 2022

(51) Int. Cl.

| | |
|---|---|
| ***A47L 9/04*** | (2006.01) |
| ***A46B 9/12*** | (2006.01) |
| ***A46B 13/00*** | (2006.01) |
| ***A46B 13/02*** | (2006.01) |
| ***A46B 15/00*** | (2006.01) |
| ***A47L 9/16*** | (2006.01) |
| ***A47L 9/28*** | (2006.01) |

(52) U.S. Cl.

CPC ..... *A47L 9/0477* (2013.01); *A46B 9/12* (2013.01); *A46B 13/006* (2013.01); *A46B 13/02* (2013.01); *A46B 15/0081* (2013.01); *A47L 9/1683* (2013.01); *A47L 9/2826* (2013.01); *A47L 9/2847* (2013.01); *A46B 2200/3033* (2013.01)

(58) Field of Classification Search

CPC .... A47L 9/0477; A47L 9/1683; A47L 9/2826; A47L 9/2847; A47L 9/0444; A47L 5/30; A47L 9/04; A46B 9/12; A46B 13/006; A46B 13/02; A46B 15/0081; A46B 2200/3033; A46B 13/001; A46B 9/16; A46B 9/28; A46B 13/00; A46B 15/00; A46B 2200/30

USPC ..... 15/319

See application file for complete search history.

(56) References Cited

U.S. PATENT DOCUMENTS

| | | | |
|---|---|---|---|
| 1,889,224 | A | 11/1932 | Smellie |
| 2,459,007 | A | 1/1949 | Taylor |
| 2,659,921 | A | 11/1953 | Osborn |
| 3,597,789 | A | 8/1971 | Boyd |
| 4,173,807 | A | 11/1979 | Maier |
| 4,912,805 | A | 4/1990 | Krasznai et al. |
| 5,003,663 | A | 4/1991 | Sunagawa et al. |

(Continued)

FOREIGN PATENT DOCUMENTS

| | | | |
|---|---|---|---|
| EP | 2941994 | A1 | 11/2015 |
| EP | 3646756 | A1 | 5/2020 |

(Continued)

OTHER PUBLICATIONS

European Patent Office, Extended Search Report re Corresponding Application No. 22174491.5-1016, dated Oct. 11, 2022, 8 pages, Munich, Germany.

*Primary Examiner* — Robert J Scruggs

(74) *Attorney, Agent, or Firm* — McGarry Bair PC

(57) ABSTRACT

A brushroll for a surface cleaning apparatus includes a brush dowel defining a central rotational axis which extends longitudinally through the brush dowel. The brush dowel includes bristle supports, sweeper supports, and a shroud surface extending between the bristle supports and the sweeper supports. A plurality of bristles protrude from the bristle supports.

19 Claims, 10 Drawing Sheets

(56) References Cited

U.S. PATENT DOCUMENTS

| | | | | |
|---|---|---|---|---|
| 5,255,409 | A * | 10/1993 | Fujiwara | A47L 9/2831 15/412 |
| 5,452,490 | A | 9/1995 | Brundula et al. | |
| 5,495,634 | A | 3/1996 | Brundula et al. | |
| 6,530,106 | B1 | 3/2003 | Brundula | |
| 6,539,575 | B1 | 4/2003 | Cohen | |
| 9,320,399 | B2 * | 4/2016 | Ventress | A46B 9/026 |
| 9,480,374 | B2 | 11/2016 | Li et al. | |
| 11,109,727 | B2 * | 9/2021 | Burbank | A47L 9/0411 |
| 2005/0039282 | A1 | 2/2005 | Paterson et al. | |
| 2005/0278888 | A1 * | 12/2005 | Reindle | A47L 9/2857 15/319 |
| 2010/0306957 | A1 | 12/2010 | Follows et al. | |
| 2010/0318232 | A1 * | 12/2010 | Tiekoetter | A47L 9/02 700/282 |
| 2012/0017936 | A1 * | 1/2012 | Dant | A46B 13/006 134/6 |
| 2014/0143978 | A1 | 5/2014 | Li et al. | |
| 2014/0259475 | A1 * | 9/2014 | Doughty | A47L 9/04 15/207.2 |
| 2014/0259522 | A1 | 9/2014 | Kasper | |
| 2014/0304941 | A1 | 10/2014 | Eriksson | |
| 2014/0331446 | A1 | 11/2014 | Eriksson | |
| 2017/0150859 | A1 * | 6/2017 | Muir | A47L 9/0444 |
| 2018/0020890 | A1 * | 1/2018 | Cho | A47L 9/242 15/347 |
| 2018/0125315 | A1 * | 5/2018 | Kasper, Jr. | A46B 13/001 |
| 2018/0249875 | A1 * | 9/2018 | Hooley | A47L 9/2821 |
| 2019/0208971 | A1 * | 7/2019 | O'Brien | A47L 11/4041 |
| 2019/0298126 | A1 * | 10/2019 | Conrad | A47L 9/0494 |
| 2021/0038041 | A1 | 2/2021 | Pruiett | |

FOREIGN PATENT DOCUMENTS

| | | | |
|---|---|---|---|
| GB | 0584478 | | 1/1947 |
| GB | 1321081 | | 6/1973 |
| GB | 1374420 | | 11/1974 |
| KR | 1020040096192 | A | 11/2004 |
| KR | 100820740 | B1 * | 4/2008 |

* cited by examiner

SURFACE CLEANING APPARATUS HAVING A BRUSHROLL

BACKGROUND

Vacuum cleaners can include an agitator for agitating debris on a surface to be cleaned so that the debris is more easily ingested into the vacuum cleaner. In some cases, the agitator comprises a brushroll that rotates within a base or floor nozzle. Such brushrolls can be rotatably driven by a motor, a turbine fan or a mechanical gear train, for example.

BRIEF SUMMARY

According to one aspect of the present disclosure, a vacuum cleaner comprises a base comprising an agitator chamber and a suction nozzle opening in fluid communication with the agitator chamber, an upright body pivotally mounted to the base and comprising a main support section supporting a cyclonic collection system comprising a cyclone separator, a suction source in fluid communication with the cyclonic collection system, and a brushroll positioned within the agitator chamber for rotational movement about a central rotational axis, the brushroll comprising a brush dowel configured to be mounted for rotation about the central rotational axis, which extends longitudinally through the brush dowel, and comprising opposing bristle supports defining first mounting surfaces, opposing sweeper supports defining second mounting surfaces, and a shroud surface extending between the opposing bristle supports and the opposing sweeper supports, and a plurality of bristle tufts fastened to each of the opposing bristle supports and projecting from one of the first mounting surfaces, and a sweeper fastened to each of the opposing sweeper supports and projecting from one of the second mounting surfaces.

According to another aspect of the present disclosure, a vacuum cleaner comprises a base comprising an agitator chamber and a suction nozzle opening in fluid communication with the agitator chamber, an upright body pivotally mounted to the base and comprising a main support section supporting a cyclonic collection system comprising a cyclone separator, a suction source in fluid communication with the cyclonic collection system, a brushroll positioned within the agitator chamber for rotational movement about a central rotational axis and comprising a brush dowel configured to be mounted for rotation about the central rotational axis, which extends longitudinally through the brush dowel, and a floor type sensor configured to provide a sensor output indicative of a type of floor beneath the vacuum cleaner, wherein the sensor output indicative of the type of floor determines a speed at which the brush dowel is rotated about the central rotational axis.

According to yet another aspect of the present disclosure, a brushroll for a vacuum cleaner comprises a brush dowel configured to be mounted for rotation about a central rotational axis, which extends longitudinally through the brush dowel, and comprising opposing bristle supports defining first mounting surfaces, opposing sweeper supports defining second mounting surfaces, and a shroud surface extending between the opposing bristle supports and the opposing sweeper supports, and a plurality of bristle tufts fastened to each of the opposing bristle supports and projecting from one of the first mounting surfaces, and a sweeper fastened to each of the opposing sweeper supports and projecting from one of the second mounting surfaces.

DETAILED DESCRIPTION

Figure 1:
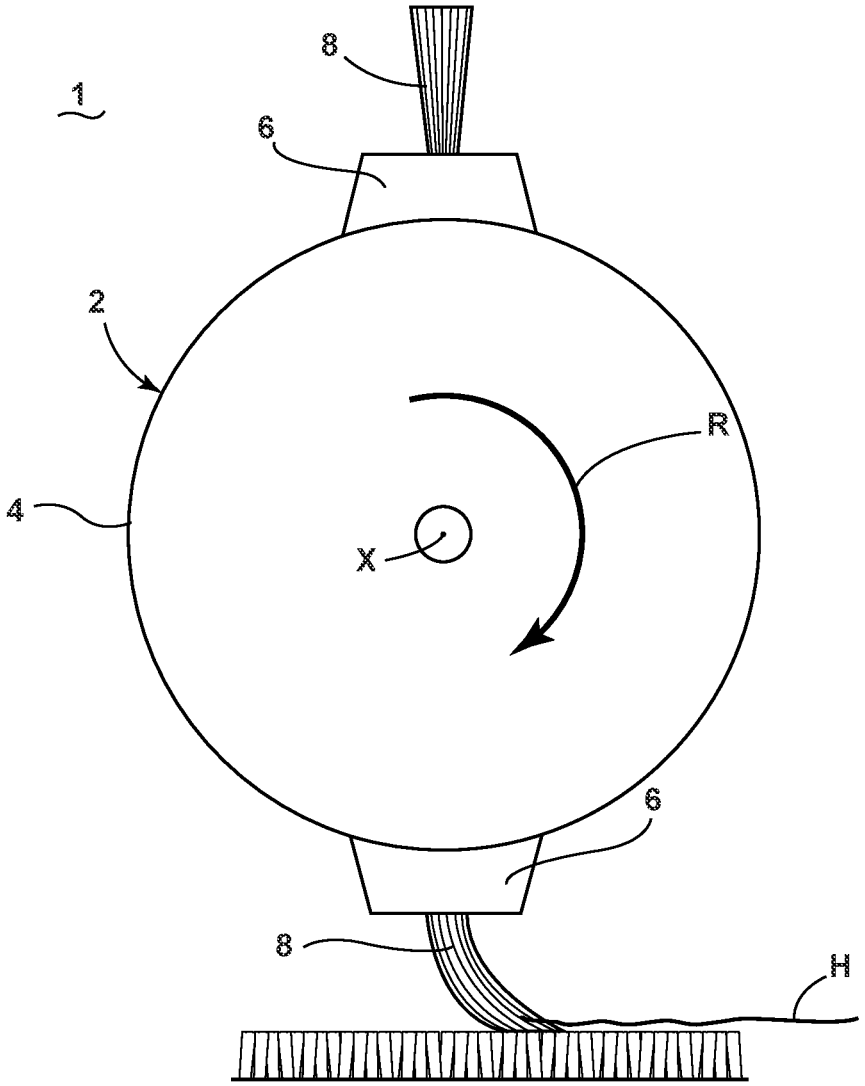
FIG. 1 (Prior Art)
FIG. 1 is a schematic cross section of a conventional brushroll for a vacuum cleaner.

Brushrolls typically have a generally cylindrical dowel that can include multiple sweeping features or elements, such as multiple bristle tufts extending radially from the dowel. In operation, debris on a surface to be cleaned is swept up by the brushroll. In some cases, elongated debris, such as hair, may become wrapped around the brushroll and must be removed by a user by manually pulling or cutting the hair off the brushroll. Further, such brushrolls can include features that may optimize the performance of the brushroll in sweeping up debris from a specific type of surface to be cleaned. For example, some brushrolls can be designed to be more effective at sweeping up debris from soft surfaces, such as carpeted floors, rugs, or upholstered surfaces, while other brushrolls include sweeping features or elements that optimize the brushroll instead for sweeping up debris from hard surfaces, such as bare floors, wood floors, tile, linoleum, or the like. However, this can result in brushrolls designed for use on either soft or hard surfaces that are, in turn, not as effective at sweeping up debris from other types of surfaces.

The present disclosure relates to a surface cleaning apparatus having a rotatable brushroll. An aspect of the disclosure relates to vacuum cleaner or accessory tool for a vacuum cleaner having a rotatable brushroll. In particular, the present disclosure relates to an improved brushroll design which reduces tangling, such as hair wrap, about the brushroll and is also adapted for multi-surface use, such as to sweep up debris from both soft surfaces and hard surfaces. According to one aspect of the present disclosure, a brushroll includes a dowel, a plurality of bristles protruding from the dowel, at least one elastomeric sweeping element protruding from the dowel, and a shroud surface which is positioned relative to the bristles to minimize hair wrap. According to another aspect of the present disclosure, a brushroll includes a dowel, a plurality of bristles protruding from the dowel, and at least one elastomeric sweeping element protruding from the dowel, wherein at least one of the plurality of bristles or the at least one elastomeric sweeping element protruding from the dowel are provided in a single chevron pattern or shape on the dowel. According to yet another aspect of the present disclosure, a brushroll includes concave curved tufting surfaces to which bristle tufts and/or at least one elastomeric sweeping element are mounted or secured to minimize hair wrap.

According to yet another aspect of the present disclosure, a vacuum cleaner includes a plurality of headlights that are configured to function as a status indicator system for providing a visual indication of an operational status or characteristic for at least one component of the vacuum cleaner.

According to yet another aspect of the present disclosure, a vacuum cleaner includes at least one ultrasonic floor type sensor configured to sense the type of surface to be cleaned by the vacuum cleaner and to alter the operation of the vacuum cleaner based on the sensed floor type.

It will be understood that while an upright vacuum cleaner is illustrated herein that the brushrolls, headlights, and floor type sensor can be used with various surface cleaning apparatus, including an upright-type vacuum cleaner, a canister-type vacuum cleaner, a stick vacuum cleaner, an autonomous or robotic vacuum cleaner, or a hand-held vacuum cleaner, or accessory tools therefore. Furthermore, the vacuum cleaner or accessory tool can additionally be configured to distribute a fluid and/or to extract a fluid, where the fluid may, for example, be liquid or steam. The term "surface cleaning apparatus" as used herein includes both vacuum cleaners and accessory tools for vacuum cleaners, unless expressly noted. Additionally, in some aspects of the present disclosure the surface cleaning apparatus including the illustrated vacuum cleaner can have fluid delivery capability for applying a fluid, including liquid and/or steam, to the surface to be cleaned, and/or fluid extraction capability for extracting fluid from the surface to be cleaned.

FIG. 1 is a schematic cross section of a conventional brushroll 1 for a vacuum cleaner. The brushroll 1 includes a brush dowel 2 configured to be mounted for rotation about a central rotational axis X extending longitudinally through the dowel 2. The dowel 2 includes a cylindrical core 4 and one or more bristle supports 6 projecting from the core 4. A plurality of bristles 8 protrude from the bristle supports 6. The bristles 8 can be provided in a series of discrete tufts or in a continuous strip.

Figure 2:
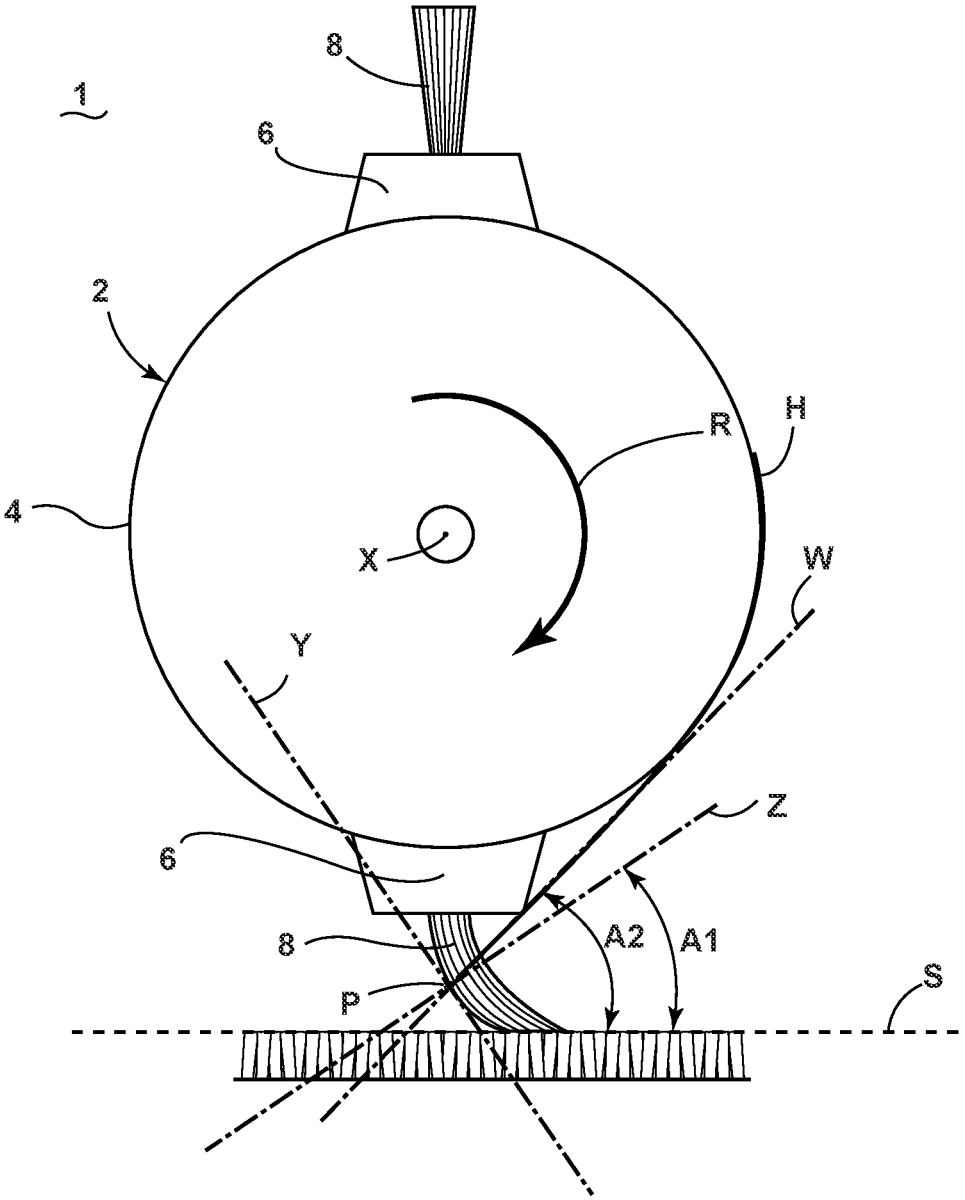
FIG. 2 (Prior Art)
FIG. 2 is a view similar to FIG. 1 showing the conventional brushroll during operation.

FIGS. 1-2 show an exemplary operation of the brushroll 1. During operation, the brushroll 1 is configured to be rotationally driven in the direction indicated by arrow R. As the bristles 8 come into contact with the surface to be cleaned, the bristles 8 are deflected. Debris, which can include, but is not limited to, dirt, dust, and hair, on the surface to be cleaned is swept up by the brushroll 1. In the present example, for purposes of simple illustration, a single hair H on the surface is shown as being picked up by the brushroll 1 in FIG. 1 by the bristles 8 in contact with the surface. The bristles 8 lift the hair H off the surface and around the dowel 2 as the brushroll 1 rotates.

In some cases, the hair H may be pulled off the bristles 8 by the suction force of the vacuum cleaner. In other cases, as the bristles 8 holding the hair H continue along the rotational path determined by the dowel 2, the hair H can become wrapped around the dowel 2, as shown in FIG. 2.

As the bristles 8 holding the hair H again come into contact with the surface to be cleaned, the hair H extends from an attachment point P, which is where at least one strand of hair H is attached to at least one bristle 8. When viewed from the side, the surface to be cleaned defines a surface line S, and the deflected bristles 8 define a bristle deflection line Y, which is the tangent line to the curve defined by the deflected bristles 8 at the attachment point P. A deflection angle A1 is defined by the included angle formed by the surface line S and a line Z, which is the line orthogonal to the bristle deflection line Y at the intersection of the bristle deflection line Y with the surface line S. The hair H defines a hair wrap line W, which is the line defined by the hair H from the attachment point P where it extends from or leaves the bristles 8. In some cases, the portion of the hair H extending immediately from the bristles 8 may extend substantially linearly before curving around the dowel 2, and so that hair wrap line W can follow that linear portion of the hair H. A hair wrap angle A2 is defined by the included angle formed by the surface line S and the hair wrap line W. It is noted that the hair H can be caught in various locations by the bristles 8, but that, regardless of where the hair is attached to the bristles, the wrapped hair H will have at least some portion that extends from the bristles 8 in the direction opposite to brushroll rotation R.

It has been found that for brushroll designs where the hair wrap angle A2 is greater than the deflection angle A1 (in other words, where A2>A1), the hair is pulled toward the root of the bristles 8 and becomes tightly wrapped around the dowel 2. In this case, the hair cannot be pulled off the brushroll 1 by the suction force of the vacuum cleaner, and the user must manually remove the hair.

Aspects of the present disclosure include brushroll designs in which the hair wrap angle A2 is less than or equal to the deflection angle A1 (in other words, where A2≤A1). Such brushrolls prevent or greatly reduce the amount of hair wrap during operation. By way of non-limiting example, other suitable examples of such exemplary brushroll designs having the hair wrap angle A2 that is less than or equal to the deflection angle A1 (in other words, where A2≤A1) are set forth in detail in U.S. Pat. No. 10,602,895, issued Mar. 31, 2020, and titled "Brushroll for Vacuum Cleaner," which is incorporated herein by reference in its entirety.

Figure 3:
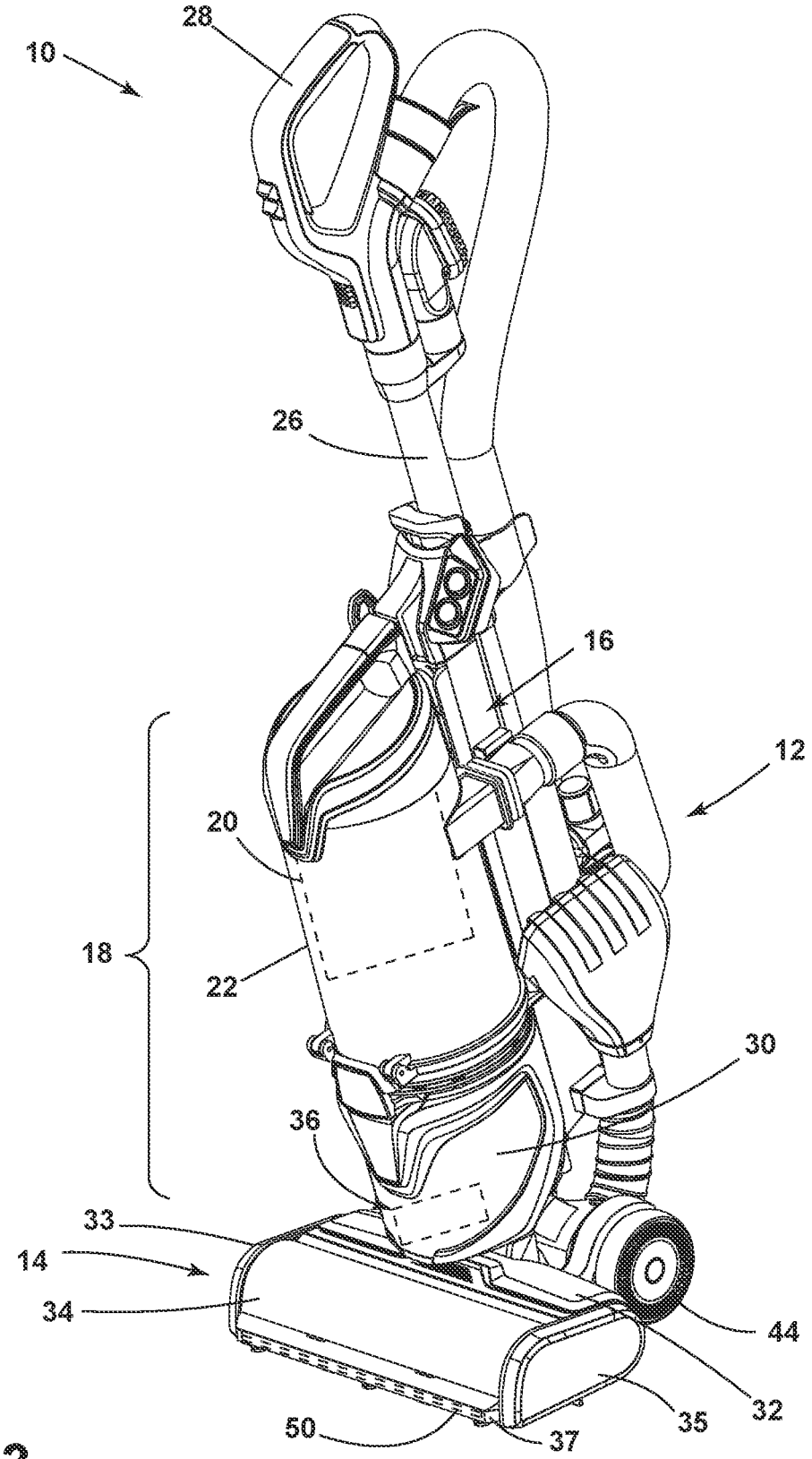
FIG. 3 is a perspective view of a surface cleaning apparatus in the form of a vacuum cleaner including a lower base according to an aspect of the present disclosure.

FIG. 3 is a perspective view of a surface cleaning apparatus in the form of a vacuum cleaner 10 and more specifically in the form of an upright vacuum cleaner according to an aspect of the present disclosure. While shown and referred to herein as an upright vacuum cleaner, the vacuum cleaner 10 can alternatively be configured as a stick vacuum cleaner, an autonomous or robotic vacuum cleaner, a hand-held vacuum cleaning device, or as an apparatus having a floor nozzle or a hand-held accessory tool connected to a canister or other portable device by a vacuum hose. Additionally, the vacuum cleaner 10 can be configured to have fluid distribution capability and/or extraction capability.

For purposes of description related to the figures, the terms "upper," "lower," "right," "left," "rear," "front," "vertical," "horizontal," and derivatives thereof shall relate to the present disclosure as oriented in FIG. 3 from the perspective of a user behind the vacuum cleaner, which defines the rear of the vacuum cleaner 10. However, it is to be understood that the aspects of the present disclosure may assume various alternative orientations, except where expressly specified to the contrary.

As illustrated, the vacuum cleaner 10 includes an upright body 12 operably coupled to a base 14. The upright body 12 generally includes a main support section 16 supporting a collection system 18 for separating and collecting contaminants from a working airstream for later disposal. In one conventional arrangement illustrated herein, the collection system 18 can include a cyclone separator 20, which can be thought of as a cyclonic collection system, for separating contaminants from a working airstream and integrally formed with a dirt cup 22 for receiving and collecting the separated contaminants from the cyclone separator 20. The dirt cup 22 can be removable from the main support section 16 and be provided with a bottom-opening dirt door for contaminant disposal. The cyclone separator 20 can have a single cyclonic separation stage, or multiple stages. In another conventional arrangement, the collection system 18 can include a separately formed cyclone separator and dirt cup. It is understood that other types of collection systems 18 can be used, such as centrifugal separators or bulk separators. In yet another conventional arrangement, the collection system 18 can include a filter bag. The vacuum cleaner 10 can also be provided with one or more additional filters upstream or downstream of the collection system 18.

The upright body 12 can be pivotally mounted to the base 14 for movement between an upright storage position, shown in FIG. 3, and a reclined use position (not shown). The vacuum cleaner 10 can be provided with a detent mechanism, such as a pedal (not shown) pivotally mounted to the base 14, for selectively releasing the upright body 12 from the storage position to the use position.

The upright body 12 also has an elongated handle 26 extending upwardly from the main support section 16 that is provided with a hand grip 28 at one end that can be used for maneuvering the vacuum cleaner 10 over a surface to be cleaned.

A motor cavity 30 is formed at a lower end of the main support section 16 and contains a conventional suction source, such as a motor/fan assembly 36, positioned therein in fluid communication with the collection system 18. The vacuum cleaner 10 can also be provided with one or more additional filters upstream or downstream of the motor/fan assembly 36.

Figure 4:
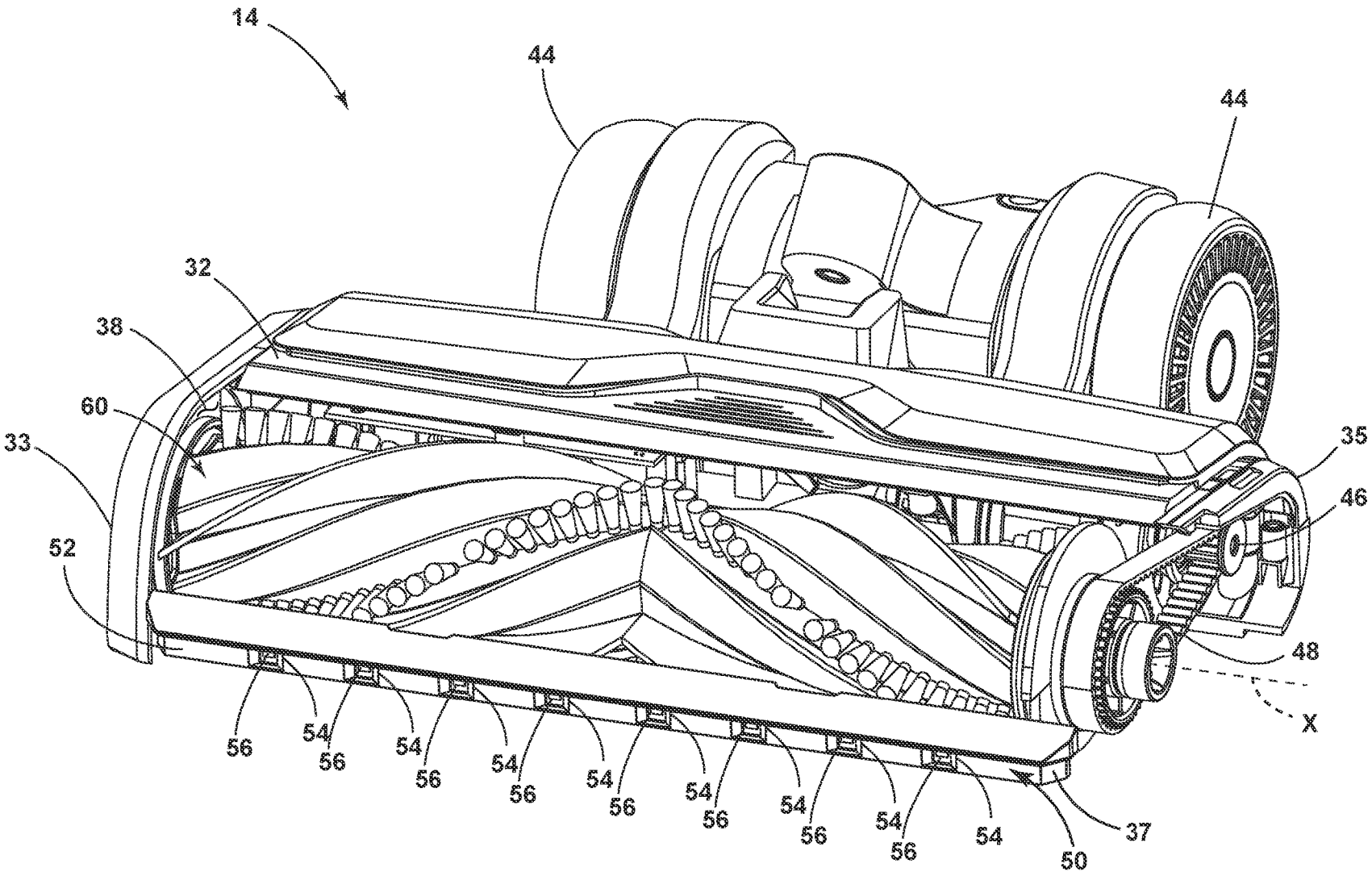
FIG. 4 is an enlarged front perspective view of the lower base of the vacuum cleaner of FIG. 3, with a portion of a housing removed for clarity.

The base 14 can include a housing 32 that couples with a cover 34 to create a partially enclosed space therebetween. An agitator chamber 38 (FIG. 4) can be provided at a forward portion of the housing 32 for receiving a brushroll 60 (FIG. 4). A suction nozzle opening 42 (FIG. 5) is formed in the housing 32 and is in fluid communication with the agitator chamber 38 and the collection system 18. Wheels 44 can be provided on the base 14 for maneuvering the vacuum cleaner 10 over a surface to be cleaned.

Specifically, the housing 32 can extend between a first side 33 and a second side 35 and, along with the cover 34, can at least partially define the agitator chamber 38 therebetween. A front bar 37 extends between the first side 33 and the second side 35 along a lower portion of the housing 32. The front bar 37 is configured to be located behind the cover 34 when the cover 34 is mounted. A headlight array 50 is illustrated as being located on the front bar 37 and extending along the width of the housing 32 between the first side 33 and the second side 35. The headlight array 50 can be any suitable illumination assembly, including an LED headlight array. Even though the headlight array 50 is positioned under the cover 34, it can be considered to be positioned along an outer portion of the housing 32. In one example, the cover 34 can include a transparent portion such that, when installed, the transparent portion covers and protects the headlight array 50 and permits emitted light to shine through to the surface to be cleaned. In another example, the cover 34 can leave the headlight array 50 uncovered so as not to block emitted light from the headlight array 50.

The base 14 can further include an optional suction nozzle height adjustment mechanism for adjusting the height of the suction nozzle opening 42 with respect to the surface to be cleaned. An actuator or selector (not shown) for actuating the adjustment mechanism can be provided on the exterior of the base 14, or at any other suitable location on the vacuum cleaner 10. In another variation, the suction nozzle height adjustment mechanism can be eliminated.

In FIG. 4, a lower portion of the vacuum cleaner 10, and specifically a portion of the base 14 including at least a portion of the housing 32, is shown with the cover 34 removed to better illustrate features of the base 14. The brushroll 60 is positioned within the agitator chamber 38 for rotational movement about a central rotational axis X. A single brushroll 60 is illustrated; however, it is within the scope of the present disclosure for more than one brushroll 60 to be used, such as, by way of non-limiting example, for dual rotating brushrolls 60 to be used. Moreover, it is within the scope of the present disclosure for the brushroll 60 to be mounted within the agitator chamber 38 in a fixed or floating vertical position relative to the agitator chamber 38 and to the housing 32.

The brushroll 60 can be operably coupled to and driven, either directly or indirectly, by the motor/fan assembly 36 in the motor cavity 30. The base 14 can include a motor shaft 46 that is operably coupled to and driven by the motor/fan assembly 36. The motor shaft 46 is oriented substantially parallel to the surface to be cleaned and can be located in a rear portion of the base 14. In one non-limiting example, the motor shaft 46 can protrude into the rear portion of the base 14 adjacent to the agitator chamber 38. A drive belt 48 operably connects the motor shaft 46 to the brushroll 60 for transmitting rotational motion of the motor shaft 46 to the brushroll 60. Alternatively, a separate, dedicated agitator drive motor (not shown) can be provided within the base 14 to drive the motor shaft 46 and the brushroll 60, either in cooperation with or independently of the operation of the motor/fan assembly 36. Further, while the brushroll 60 is described herein as being rotatably driven by a motor, it is understood that the brushroll 60 can be driven by other means, such as, but not limited to, a turbine fan or a mechanical gear train.

In operation, the vacuum cleaner 10 draws in debris-laden air through the base 14, and specifically through the suction nozzle opening 42, and into the collection system 18 where the debris, which can include, but is not limited to, dirt, dust, hair, and other debris, is substantially separated from the working air flow, which is generated by the motor/fan assembly 36. The spinning motor shaft 46 that can be operably coupled to the motor/fan assembly 36 rotates the brushroll 60 via the drive belt 48 that is operably connected therebetween. Alternatively, the separate, dedicated agitator drive motor can rotate the brushroll 60 via the motor shaft 46 and the drive belt 48 operably connected therebetween. As the brushroll 60 rotates, sweeping elements sweep across the surface to be cleaned to release and propel debris into the working air flow generated by the motor/fan assembly 36, which carries the debris into the collection system 18. The working air flow then passes through the motor cavity 30 and past the motor/fan assembly 36 prior to being exhausted from the vacuum cleaner 10. The collection system 18 can be periodically emptied of debris.

With the cover 34 removed, it can better be seen that the base 14 can further include the headlight array 50. In one example, the headlight array 50 can be provided in the form of a light bar. The headlight array 50 includes a light assembly body 52 provided within the base 14, such as along the lower front edge of the base 14 at the front bar 37. The light assembly body 52 can be integrally formed with the housing 32, though it will be understood that the light assembly body 52 can also be formed separately from the housing 32 and instead be coupled to or mounted to the housing 32 or to another component of the base 14. As illustrated herein, the headlight array 50 is positioned such that at least a portion of the light assembly body 52 is located behind or within the cover 34 when the cover 34 is in place with the housing 32. However, it is also contemplated that the light assembly body 52 can be provided on an exterior of the base 14, such as on an exterior front surface of the cover 34.

While the light assembly body 52 is illustrated herein as extending across substantially the full width of the base 14, it is also contemplated that the light assembly body 52 can extend across less than the full width of the base 14, including less than or equal to half the width of the base 14, less than or equal to one third the width of the base 14, or less than or equal to one quarter the width of the base 14. Further, while the headlight array 50 is illustrated herein as including a single monolithic light assembly body 52, it will also be understood that the headlight array 50 can alternatively include more than one light assembly body 52, with the multiple light assembly bodies 52 collectively forming the headlight array 50.

The light assembly body 52 defines a plurality of light openings 54. As illustrated herein, the light openings 54 can extend across the width of the light assembly body 52, though the light openings 54 could alternatively be provided within only a portion of the light assembly body 52. While the light openings 54 as illustrated herein as being evenly spaced across the width of the light assembly body 52, it will be understood that the light openings 54 can be provided in any suitable pattern or arrangement on the light assembly body 52.

The headlight array 50 further includes a plurality of lights 56, such that at least some of the plurality of light openings 54 receive the lights 56. In one example, the lights 56 are provided as LED lights 56. As illustrated herein, each of the light openings 54 can receive at least one light 56, though it is not necessary that the number of light openings 54 and lights 56 be the same. The lights 56 are positioned such that the lights 56 emit illumination through the light openings 54. In the case that the portion of the light assembly body 52 defining the light openings 54 is positioned behind the cover 34, the cover 34 can be at least partially transparent such that the illumination from the lights 56 is visible to a user from behind the cover 34. Alternatively, or additionally, the light assembly body 52 can be positioned such that the light openings 54, and therefore also the lights 56, are not obstructed by the cover 34.

The operation of the headlight array 50 can be controlled by a microcontroller (not shown) located within the base 14. In one example, the lights 56 are controlled and configured to serve as headlights for the vacuum cleaner 10, emitting illumination forward from the base 14 to illuminate the surface to be cleaned during operation of the vacuum cleaner 10. Additionally, or alternatively, the headlight array 50 can be controlled and configured to function as a status indicator system to provide at least one visual indicator corresponding to an operational status or informational status of the vacuum cleaner 10 and its components.

In one non-limiting example, the headlight array 50 is configured to illuminate the surface to be cleaned during operation of the vacuum cleaner 10 and is additionally configured to indicate an operational status of the brushroll 60. During normal operation of the vacuum cleaner 10, when the headlight array provides illumination, it has been determined that the placement of the headlight array 50 in this very low position across the front of the base 14 illuminates the surface to be cleaned very well, including that dust and/or debris are illuminated exceptionally well. It has been determined that performance is noticeably better as compared to when LEDs are mounted higher up and pointing downwardly at the surface to be cleaned. Because of the low position of the headlight array 50, and because the headlight array 50 faces forward and projects illumination at substantially a horizontal projection, shadows are cast by debris on the surface to be cleaned and these shadows are very obvious to a user of the vacuum cleaner 10. It will be understood that the beam provided by the headlight array 50 can be projected with a zero-degree angle that provides a beam that is parallel to the surface to be cleaned.

The vacuum cleaner 10 can also include an over-current protection (OCP) feature to ensure that the vacuum cleaner 10 only operates under safe parameters. Under normal operation, the motor/fan assembly 36 or the separate, dedicated agitator drive motor can output a current value to operate the brushroll 60 that is not to exceed a predetermined threshold. However, under certain conditions, non-limiting examples of which include the brushroll 60 becoming tangled with debris such that it cannot rotate freely, or if rotation of the brushroll 60 is impeded by the surface to be cleaned, such as by thick carpet, the motor/fan assembly 36 or the separate, dedicated agitator drive motor may generate increased current to try to overcome the impediment and cause the brushroll 60 to rotate. If this increased current value becomes too great, such as by exceeding the predetermined threshold, components of the vacuum cleaner 10 may be damaged or subject to increased wear. In such a case of the current exceeding the predetermined threshold, the OCP feature is tripped and can cease operation of the brushroll 60 by the motor/fan assembly 36 or the separate, dedicated agitator drive motor in order to prevent damage or undue wear within the vacuum cleaner 10.

Further, if the OCP feature of the vacuum cleaner 10 is tripped due to the current operating the brushroll 60 exceeding the predetermined threshold, when operation of the brushroll 60 is ceased, the headlight array 50 can also provide a visual indication to a user to communicate to the user that the OCP has been tripped and that the brushroll 60 is no longer operating. The visual indication provided by the headlight array 50 can include a specific illumination pattern of at least some of the lights 56, such as by the lights 56 flashing or being constantly illuminated, by a change in illumination color of at least some of the lights 56, or a combination of a color change and a change in illumination pattern or frequency. In one example, the lights 56 are controlled to begin flashing when the OCP is tripped and will continue to flash until the OCP is reset, such as by power cycling the vacuum cleaner 10.

Additionally, or alternatively, the headlight array 50 can be operated to provide a visual indication for various other functions or information relating to the vacuum cleaner 10. Further non-limiting examples of such visual indications that can be provided by the headlight array 50 include other operational status information for the brushroll 60 besides the over-current protection activation, such as a rotational speed level of the brushroll 60. Further non-limiting examples of such visual indications that can be provided by the headlight array 50 include other operational status information or component information that is unrelated to the brushroll 60, including but not limited to, an indication for nozzle pressure or system pressure of the vacuum cleaner 10 that could indicate a clogged filter, a fill level of the dirt cup 22, a fill level of any included fluid dispensing systems, an operational mode of the vacuum cleaner 10, or a floor type sensed by the vacuum cleaner 10 (e.g. carpet or bare floor). It will be understood that, in such an instance, an appropriate sensor, motor, controller or other component would need to be coupled to, or otherwise provide information to, the microcontroller to allow the headlight array 50 display to provide such indications thereon.

Figure 5:
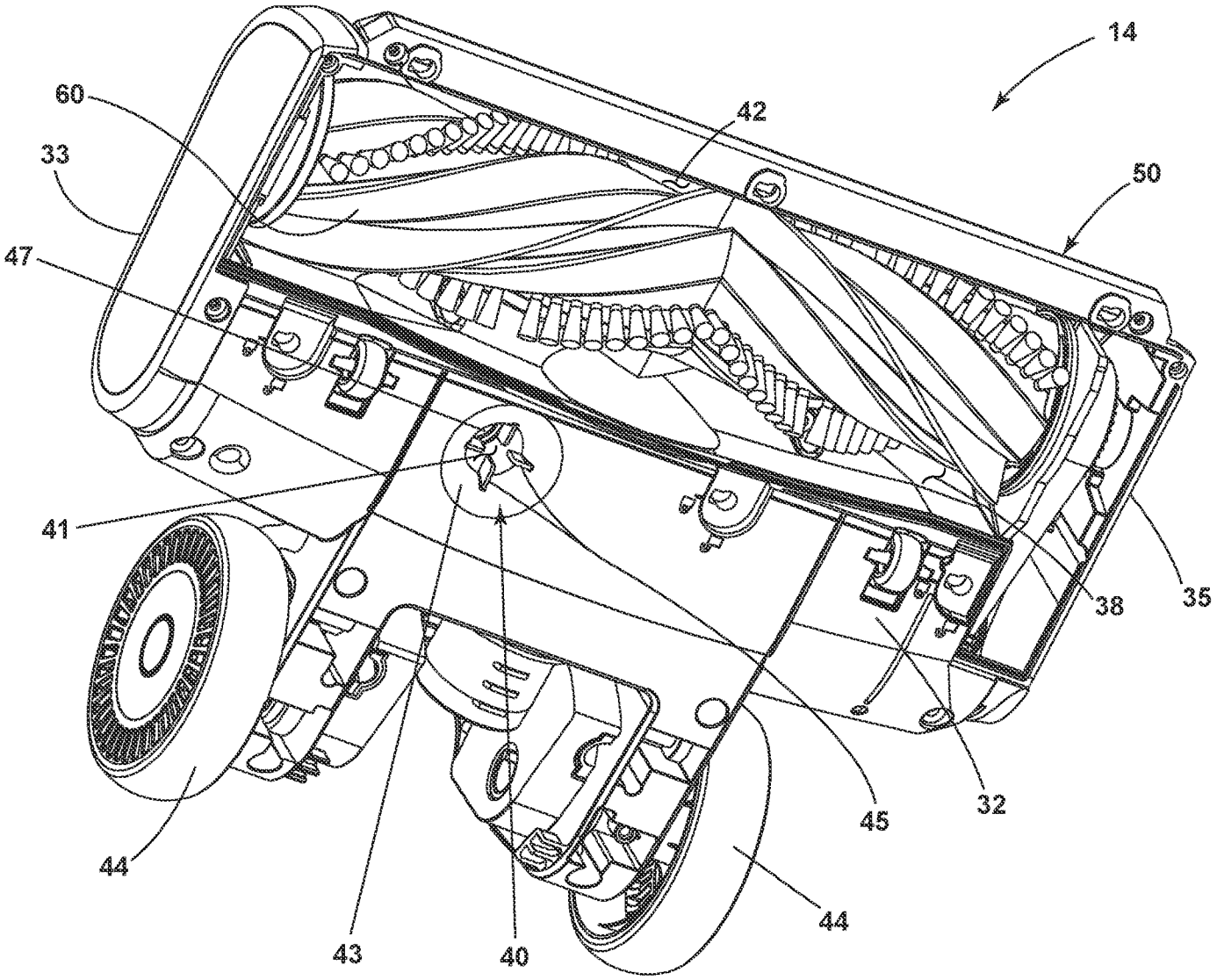
FIG. 5 is a bottom perspective view of the lower base of the vacuum cleaner of FIG. 3.

FIG. 5 is a bottom perspective view of the base 14 showing the base 14 further including a floor type sensor assembly 40. A lower surface of the base 14, such as defined in part by the housing 32, defines a sensor opening 41. A recessed portion 43 extends upwardly away from the bottom most portion of the housing 32. The sensor opening 41 includes an aperture located in the recessed portion 43. The sensor opening 41 leads into the interior of the base 14. In this manner, the sensor opening 41 is recessed into the housing 32 and provided at a vertical height above the bottom most portion of the housing 32. It will be understood that this allows the sensor opening 41 to be located further vertically above the surface to be cleaned than other portions of the housing 32. A plurality of ribs 45 can be provided within the recessed portion 43. The plurality of ribs 45 may be located in the sensor opening 41 and extend a width of the sensor opening 41 from a wall of the recessed portion 43 defining the sensor opening 41. While the ribs 45 are illustrated herein as being evenly spaced from one another about the circumference of the sensor opening 41, it will be understood that any suitable number of ribs 45 can be provided, including only a single rib 45, and the plurality of ribs 45 can be provided in any suitable arrangement and spacing about the sensor opening 41. The plurality of ribs 45 can also be joined together or otherwise form a support within the sensor opening 41. While the plurality of ribs 45 forming the support is illustrated as centralized within the sensor opening 41, it need not be.

A floor type sensor 47 can be retained or otherwise supported by the plurality of ribs 45. The floor type sensor 47 can be provided adjacent or within the sensor opening 41. More specifically, the ribs 45 and floor type sensor 47 can be configured such that the floor type sensor 47 can be held in place within the base 14. In one example, the floor type sensor 47 can be provided within the recessed portion 43 such that the floor type sensor 47 is recessed vertically above a bottom most portion of the housing 32 and can sense the floor type through the sensor opening 41. It is contemplated that the floor type sensor 47 can be located entirely within the interior of the base 14 or that the floor type sensor 47 can protrude from the sensor opening 41 into the recessed portion 43. Alternatively, the floor type sensor 47 can be even with or extend below portions of the housing 32.

In one example, the floor type sensor 47 is provided in the form of an ultrasonic floor type sensor 47. The ultrasonic floor type sensor 47 can sense a floor type of the surface to be cleaned. More specifically, the floor type sensor 47 can through contactless detection measure, sense, or otherwise detect or determine the type of surface. By way of non-limiting example, the floor type sensor 47 can provide an output related to the floor type. It will be understood that different materials absorb and reflect ultrasonic energy differently. The ultrasonic floor type sensor 47 can produce and monitor an ultrasonic wave reflected by the surface to be cleaned and provide an output related thereto. The output can be indicative of the floor type as compared to a predetermined threshold, range, or known metric for various flooring. The floor type sensor 47 can be operably coupled with a controller (not shown), which can be an overall controller for the vacuum cleaner 10, the microcontroller located within the base 14, or an additional microcontroller provided within the base 14 separate from that previously described. The floor type sensor 47 can be operated automatically during the operation of the vacuum cleaner 10 or in response to an input or control from the user. Further, the floor type sensor 47 can be operated when the vacuum cleaner 10 is stationary, when the vacuum cleaner 10 is being moved along the surface to be cleaned, when the brushroll 60 is operating, when the brushroll 60 is not operating, or any combination thereof.

The floor type sensor 47 is operated and provides an output related to the type of floor beneath the vacuum cleaner 10 and specifically beneath the floor type sensor 47. In one example, the floor type sensor 47 senses the surface to be cleaned and provides a sensor output to the operably coupled controller that is indicative of a hard floor or a soft floor, such as a carpeted floor. Additionally, or alternatively, the floor type sensor 47 can provide a sensor output to the controller that is indicative of the specific floor type, non-limiting examples of which can include carpet, rug, bare floor, wood floor, tile, linoleum, etc. Based upon the output from the floor type sensor 47 received by the controller, the controller can be operated to set or to alter the operation of the brushroll 60, either directly, such as in the case where the same microcontroller in the base 14 is operably coupled with both the brushroll 60 and the floor type sensor 47, or indirectly, such as in the case where the controller for the floor type sensor 47 is separate from, but operably coupled with, the microcontroller located within the base 14.

By way of non-limiting example, the sensor output received by the controller from the floor type sensor 47 is used by the controller to control the operation of the brushroll 60, and specifically is used by the controller to set or actively adjust the speed of rotation of the brushroll 60 by the motor shaft 46. If the floor type sensor 47 provides output indicating a hard floor type, the controller causes the brushroll 60 to be rotated at a slower speed relative to the speed of rotation for a carpeted floor. Conversely, if the floor type sensor 47 provides output indicating a carpeted floor type, the controller causes the brushroll 60 to be rotated at a faster speed relative to the speed of rotation for a bare or hard floor. Determining and dynamically controlling the speed of rotation of the brushroll 60 based on the floor type sensed by the floor type sensor assembly 40 results in improved cleaning performance as compared to constantly rotating the brushroll 60 at only a single speed regardless of the type of surface being cleaned. For example, operating the brushroll 60 at a higher speed on a hard floor surface can result in debris being scattered across the surface, rather than being swept up by the brushroll 60 and ingested by the vacuum cleaner 10. By reducing the rotational speed of the brushroll 60 when the floor type sensor 47 indicates a hard floor type, debris scatter can be reduced compared to rotation of the brushroll 60 at a higher speed.

By including the floor type sensor assembly 40 and determining the speed at which the brushroll 60 should be rotated based upon the floor type sensed by the floor type sensor 47, the operation of the vacuum cleaner 10 and of the brushroll 60 is dynamically controlled based upon the sensed floor type such that both the vacuum cleaner 10 and the brushroll 60 are configured for multi-surface cleaning without any need for the user to change any components or to select a specific floor type cleaning mode of operation in advance. Further, it is contemplated that the floor type sensor assembly 40 can be operated during operation of the vacuum cleaner 10, either intermittently or continuously, such that the user can go back and forth between hard floor types and carpeted floor types and the operation of the vacuum cleaner 10 and the brushroll 60 can accordingly be adjusted in real time for instant customization of the rotational speed of the brushroll 60. It will be understood that the term continuously can also include repeated predetermined intervals and need not be constant. However, it is also within the scope of the present disclosure for the floor type sensor assembly 40 to be utilized only when the vacuum cleaner 10 is stationary or only when the brushroll 60 is not operating, rather than throughout an entire operation of the vacuum cleaner 10.

Figure 6:
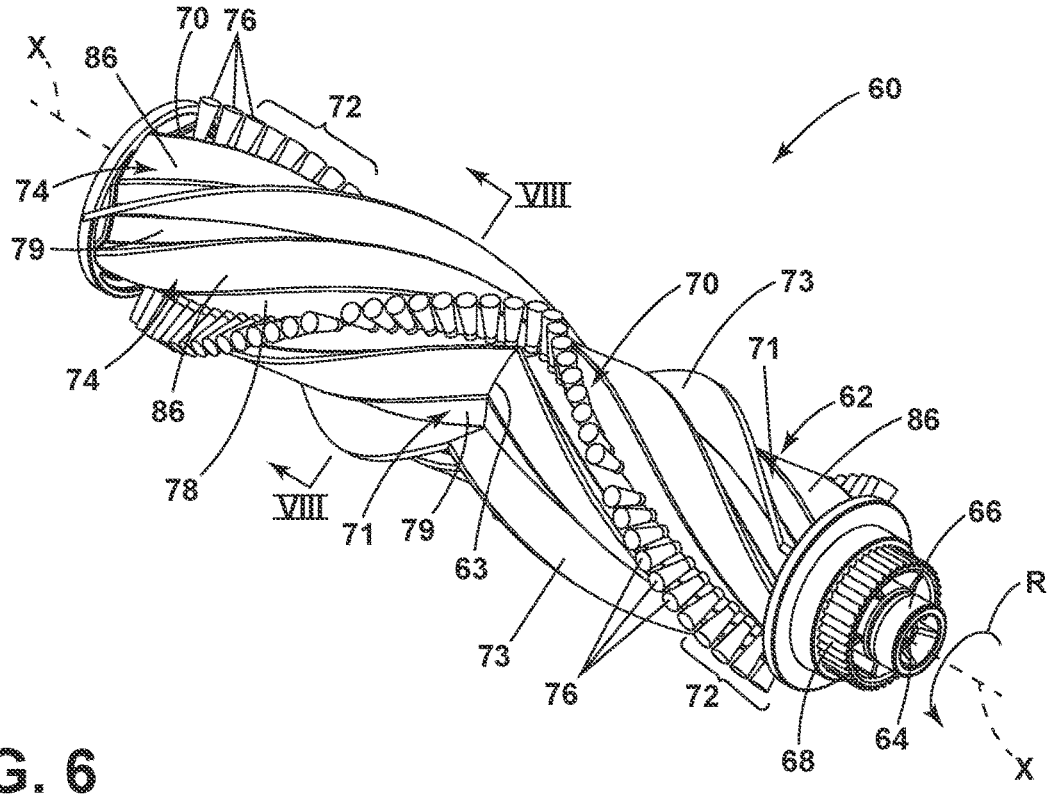
FIG. 6 is a perspective view of a brushroll of the vacuum cleaner of FIG. 3.

FIG. 6 is a perspective view of the brushroll 60. The brushroll 60 includes a brush dowel 62 configured to be rotated about the central rotational axis X that extends longitudinally through the brush dowel 62. The brush dowel 62 is mounted for rotation on an elongated shaft 64 that extends through the center of the brush dowel 62 and defines the central rotational axis X around which the brush dowel 62 rotates. The brushroll 60 is configured to be rotationally driven in the direction indicated by arrow R. The brush dowel 62 further defines a midpoint 63 generally corresponding to a center of the longitudinal width of the brush dowel 62. A bearing 66 is mounted on at least one end of the shaft 64. In operation, the brush dowel 62 rotates about the shaft 64 on the at least one bearing 66. A belt engagement surface 68 extends around the circumference of the brush dowel 62 near one end, and communicates with the drive belt 48 (FIG. 4). The belt engagement surface 68 may include a pulley.

The brushroll 60 is designed to be configured for use with multiple types of floors or surfaces. In this manner the brushroll 60 can include more than one type of sweeping element. More specifically, the brush dowel 62 is illustrated as including one or more first sweeping element supports, illustrated herein in the form of one or more bristle supports 70. The overall outer surface of the brush dowel 62 further includes at least one first concave curved surface 78 defining first mounting surfaces 78 of the bristle supports 70. A plurality of bristles 72 protrudes from at least one of the bristle supports 70, and can be provided in a series of discrete tufts 76 or in a continuous strip so as to project from the first mounting surfaces 78 defined by the at least one first concave curved surface 78. The bristles 72 can be arranged in various patterns on the brush dowel 62, including straight, angled, helical, a chevron shape or chevron-shaped row, or combinations thereof. In the illustrated aspect, two sets of bristle supports 70 and two corresponding rows of bristle tufts 76 are provided on the brush dowel 62, each tuft 76 containing a plurality of bristles 72. Each bristle support 70 and each row of bristle tufts 76 extends generally in a single chevron pattern longitudinally along the brush dowel 62 and partially around the circumference of the brush dowel 62.

The brush dowel 62 further includes one or more second sweeping element supports, illustrated herein in the form of one or more sweeper supports 71, which project into the brush dowel 62. The overall outer surface of the brush dowel 62 further includes at least one second concave curved surface 79 defining second mounting surfaces 79 of the sweeper supports 71. At least one sweeping element, illustrated herein in the form of at least one projection 73, protrudes from at least one of the sweeper supports 71, such as from a slot formed by the sweeper support 71, which can be better seen in the view of FIG. 8. In this way, the projections 73 project from the second mounting surfaces 79 defined by the at least one second concave curved surface 79. The at least one projection 73 can be any suitable type of sweeping element, non-limiting examples of which include a strip brush, a sweeper, an elastomeric sweeper, a blade, a wiper blade, a flapper, etc. The at least one projection 73 is illustrated herein as a continuous projection 73 extending longitudinally along the sweeper support 71, though it will be understood that the at least one projection 73 can be provided in a series, set, or line of discrete projections 73. The at least one projection 73 can be arranged in various patterns on the brush dowel 62, including straight, angled, helical, a chevron shape or chevron-shaped row, or combinations thereof.

In the illustrated aspect, two sweeper supports 71 and two corresponding projections 73 are provided on the brush dowel 62, each sweeper support 71 and each projection 73 extending generally in a single chevron pattern longitudinally along the brush dowel 62 and partially around the circumference of the brush dowel 62. Further in the illustrated example, the two bristle supports 70 and two corresponding rows of bristle tufts 76 alternate about the circumference of the brush dowel 62 with the two sweeper supports 71 and two corresponding projections 73, such that the two bristle supports 70 and two corresponding rows of bristle tufts 76 are provided as an opposing pair of bristle supports 70 and corresponding rows of bristle tufts 76, with the two sweeper supports 71 and two corresponding projections 73 provided as an opposing pair of sweeper supports 71 and corresponding projections 73 interposed between the opposing pair of bristle supports 70 and corresponding rows of bristle tufts 76.

Figure 7:
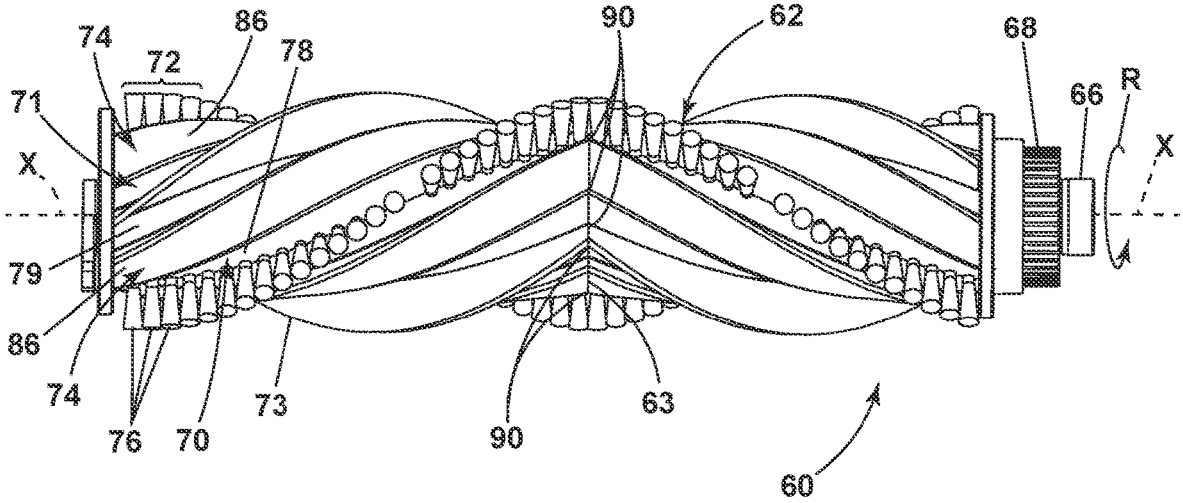
FIG. 7 is a front view of the brushroll of FIG. 6.

In the front view of the brushroll 60 shown in FIG. 7, the single chevron pattern formed by each of the bristle supports 70, each of the corresponding rows of bristle tufts 76, each of the sweeper supports 71, and each of the corresponding projections 73 extending longitudinally along the brush dowel 62 can be better seen, including that each of the bristle supports 70 projects into the brush dowel 62. Each of the bristle supports 70, each of the corresponding rows of bristle tufts 76, each of the sweeper supports 71, and each of the corresponding projections 73, and therefore also each of the first concave curved surfaces 78 defining each of the first mounting surfaces 78 and each of the second concave curved surfaces 79 defining each of the second mounting surfaces 79, forms a single chevron pattern extending longitudinally along the brush dowel 62, with the lowermost outer ends of the chevrons formed at the opposing ends of the brush dowel 62 and each of the chevrons defining a peak or apex 90 at the midpoint 63 of the brush dowel 62.

Figure 8:
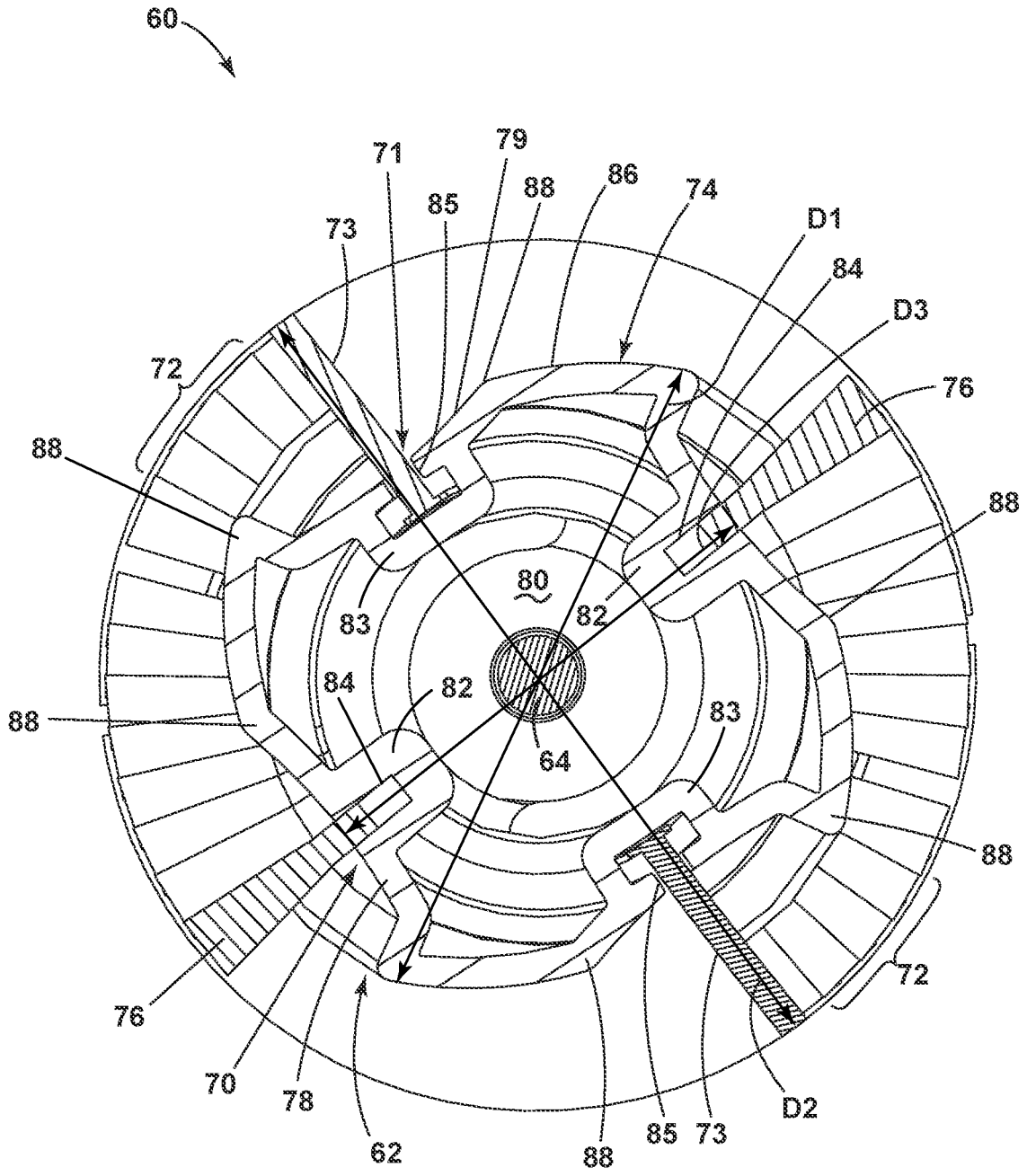
FIG. 8 is a cross-sectional view of the brushroll taken through line VIII-VIII of FIG. 6.

FIG. 8 is a cross section of the brushroll 60 taken through line VIII-VIII of FIG. 6. The brush dowel 62 can define a hollow interior 80 that extends along the length of the brush dowel 62. The shaft 64 is received within the hollow interior 80. The bristle supports 70 further include bristle support platforms 82 which project from the first concave curved surfaces 78 into the hollow interior 80 of the brush dowel 62. Bristle holes 84 for at least partially receiving the bristle tufts 76 can be formed in the first concave curved surfaces 78 and can extend at least partially into the bristle support platforms 82. Likewise, the sweeper supports 71 further include sweeper support platforms 83 which project from the second concave curved surfaces 79 into the hollow interior 80 of the brush dowel 62. Sweeper holes 85 for at least partially receiving the projections 73 can be formed in the second concave curved surfaces 79 and can extend at least partially into the sweeper support platforms 83.

The brushroll 60 is further designed to prevent or greatly reduce the amount of tangling, such as hair wrap, during operation by providing a shroud surface 74 for wrapping hair. The shroud surface 74 is provided adjacent to the bristles 72 and the projections 73 in order to establish a shallower hair wrap angle as compared to a dowel without the feature, as described in further detail below. In one example, the shroud surface 74 is provided between the bristles 72 and the projections 73 and therefore also between the bristle supports 70 and the sweeper supports 71. The overall outer surface of the brush dowel 62 includes a plurality of curved sections, provided herein in the form of convex curved surfaces 86, spaced apart from one another about the circumference of the brush dowel 62, and which together define the shroud surface 74. The overall outer surface of the brush dowel 62 further includes the at least one first concave curved surface 78 and the at least one second concave curved surface 79 as previously described.

In the illustrated aspect, the at least one first concave curved surface 78 defining the first mounting surfaces 78 of the bristle supports 70 are provided as a pair of opposing first concave curved surfaces 78 defining first mounting surfaces 78 of the corresponding opposing pair of bristle supports 70 with corresponding rows of bristle tufts 76. Likewise, the at least one second concave curved surface 79 defining the second mounting surfaces 79 of the sweeper supports 71 are provided as a pair of opposing second concave curved surfaces 79 defining second mounting surfaces 79 of the corresponding opposing pair of sweeper supports 71 with corresponding projections 73 and interposed between the opposing first concave curved surfaces 78 defining first mounting surfaces 78 of the corresponding opposing pair of bristle supports 70 with corresponding rows of bristle tufts 76.

Furthermore, the plurality of convex curved surfaces 86 defining the shroud surface 74 can be thought of as two opposing pairs of convex curved surfaces 86 defining the shroud surface 74, each of the convex curved surfaces 86 evenly spaced from one another about the circumference of the brush dowel 62. Each of the convex curved surfaces 86 is therefore provided between one first concave curved surface 78 defining the first mounting surface 78 of the corresponding bristle support 70 with the corresponding row of bristle tufts 76 on one side of the convex curved surface 86 and one second concave curved surface 79 defining the second mounting surface 79 of the corresponding sweeper support 71 with the corresponding projection 73 on the other side of the convex curved surface 86.

As noted above, the brushroll 60 is designed to prevent or greatly reduce the amount of hair wrap during operation by providing the shroud surface 74 for wrapping hair. In the illustrated aspect, the brush dowel 62 defines a major diameter D1, which is the diameter defined by the smallest circle that can enclose the shroud surface 74 of the brush dowel 62. The bristle tufts 76 and the projections 73 define a trim diameter D2, which is slightly larger than the major diameter D1. The first concave curved surfaces 78 and the second concave curved surfaces 79 are recessed below the major diameter D1, and therefore below the shroud surface 74, which allows the bristles 72 and the projections 73 on the first concave curved surfaces 78 and the second concave curved surfaces 79, respectively, to deflect when contacting the surface to be cleaned, while keeping any hair at or near the tip of the bristles 72 or of the projections 73.

For example, the bristle supports 70 that are defined by the first concave curved surfaces 78 and the sweeper supports 71 that are defined by the second concave curved surfaces 79 define a minor diameter D3 of the brush dowel 62. The minor diameter D3 can be defined at the tufting locations of the bristle tufts 76 in the bristle supports 70 and at the mounting locations of the projections 73 in the sweeper supports 71. The minor diameter D3 can be less than the major diameter D1 and the trim diameter D2. In the illustrated example, the minor diameter D3 is the diameter defined by the smallest circle that can touch both first concave curved surfaces 78 of the bristle supports 70 at the tufting locations of the bristle tufts 76 or that can touch both second concave curved surfaces 79 of the sweeper supports 71 at the mounting locations of the projections 73. Other configurations for a brushroll having bristle supports 70, sweeper supports 71, and shroud surfaces 74 may have major and minor diameters D1, D3 defined in other manners, as long as the shroud surface 74 defines D1 and the bristle supports 70 or sweeper supports 71 define D3.

Having first concave curved surfaces 78 defining the tufting surfaces of the brushroll 60, i.e. the surfaces to which the bristle tufts 76 are mounted or secured, as well as having second concave curved surfaces 79 defining the sweeper mounting surfaces of the brushroll 60, i.e. the surfaces to which the projections 73 are mounted or secured, can offer improved hair wrap reduction. The first and second concave curved surfaces 78, 79 defining the first and second mounting surfaces 78, 79 intersect the convex shroud surfaces 74 at outside corners 88 where the converging surfaces 74 and 78 or 79 meet, shown herein as raised edges 88 which can prevent hair from being wedged at the base of the bristle tufts 76 or at the base of the projections 73. With a flat mounting surface, hair may be pulled tight across the mounting surface and toward or to the base of the bristle tuft. However, with the first and second concave curved surfaces 78, 79 defining trough-shaped tufting or mounting surfaces prevent hair from being wedged at the base of the tufts 76 or the projections 73 because the hair bridging the raised edges 88 create a gap that spaces the hair from the base of the tufts 76 or the projections 73. For the purposes of this description, the term concave curved surface refers to a surface that curves inwardly toward the central rotational axis X, forming a tufting or mounting surface that is recessed from the outside corners 88. Although the first and second concave curved surfaces 78, 79 are shown in the figures as symmetric incurvate shapes, non-uniform and non-symmetric inwardly curved recesses are also contemplated. Additionally, non-arcuate recesses are also contemplated, such as planar tufting or mounting surfaces or V-shaped tufting or mounting surfaces, which are recessed inwardly toward the central rotational axis X, for example.

The illustrated aspect of the brushroll 60 further has the bristle tufts 76 positioned equidistant between the raised edges 88, and projecting radially from the brush dowel 62 at a midpoint of the first concave curved surfaces 78. Likewise, the brushroll 60 yet further has the projections 73 positioned equidistant between the raised edges 88, and projecting radially from the brush dowel 62 at a midpoint of the second concave curved surfaces 79. It should be understood that the brushroll 60 can further be designed to accommodate a secondary device, such as scissors or another hand-held cutting implement, for cutting wrapped hair, such as by including ribs and/or a channel that can be provided in the brush dowel 62.

Figure 9:
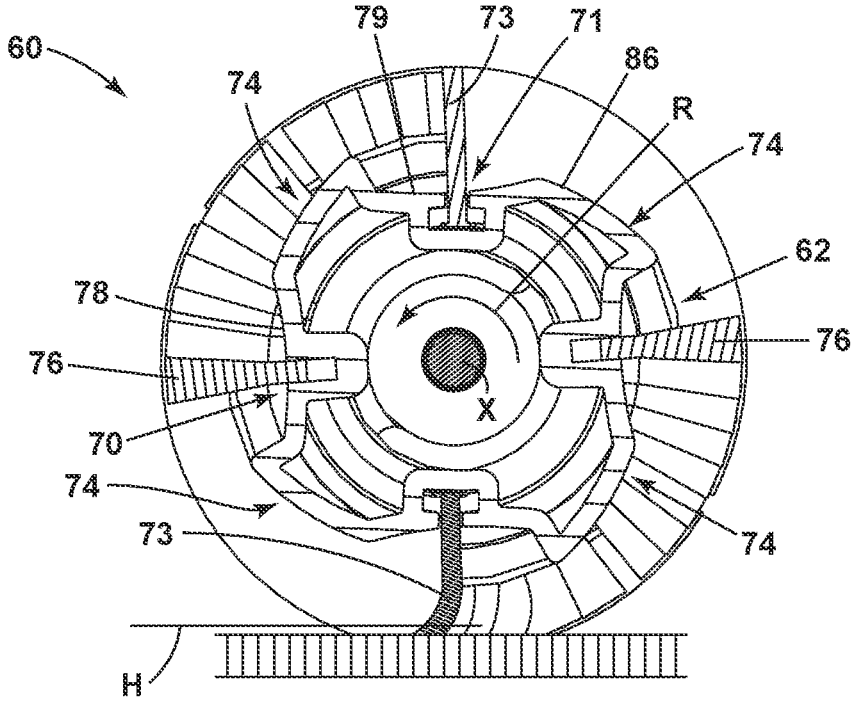
FIGS. 9-10 are views similar to FIG. 8 showing the brushroll during operation.
Figure 10:
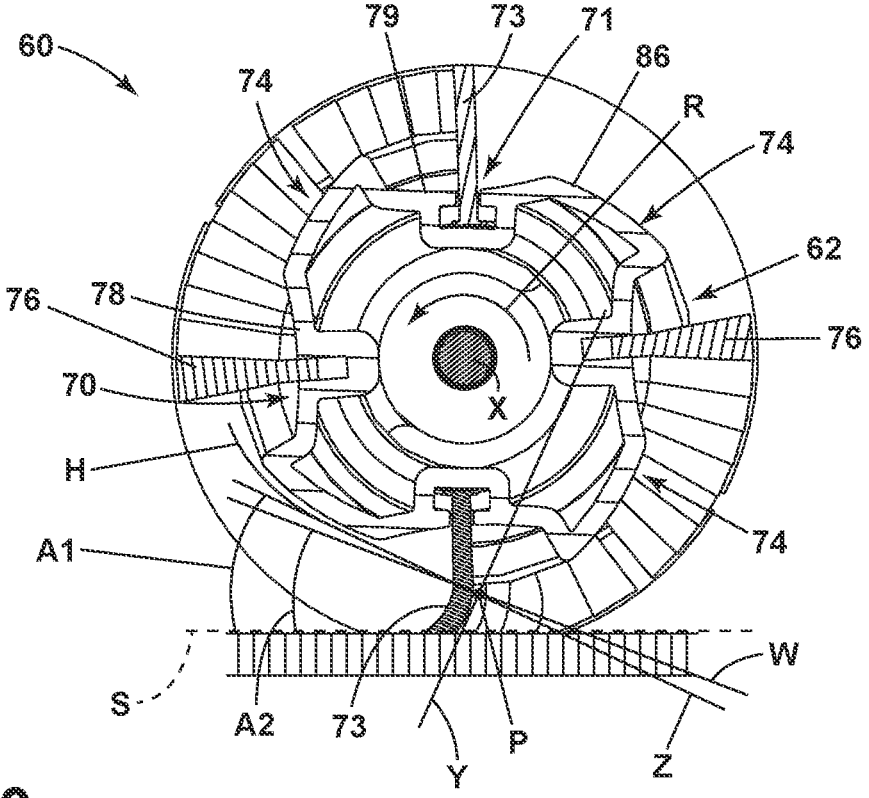

FIGS. 9-10 show an exemplary operation of the brushroll 60. The brushroll 60 is designed to have a hair wrap angle A2 that is less than or equal to the deflection angle A1 (in other words, where A2≤A1). During operation, the brushroll 60 rotates in direction R and debris including, but not limited to, dirt, dust, and hair on the surface to be cleaned is swept up by the brushroll 60. In the present example, for purposes of simple illustration, a single hair H on the surface is shown as being picked up by the brushroll 60 in FIG. 9 by the bristle tufts 76 and the projection 73 in contact with the surface. The bristle tufts 76 and the projection 73 lift the hair H off the surface and around the brush dowel 62 as the brushroll 60 rotates. In some cases, the hair H may be pulled off the brushroll 60 by the suction force of the vacuum cleaner 10. In other cases, as the bristle tufts 76 and the projection 73 holding the hair H continue along the rotational path determined by the brush dowel 62, the hair H can wrap around the shroud surface 74, as shown in FIG. 10, extending from the attachment point P to the bristle tufts 76 and around the brush dowel 62. Because the hair wrap angle A2 is shallower, the hair H remains at or near the tip of the bristle tufts 76 and the projection 73 and the hair H is not pulled toward the root of the bristles 72 or the projection 73, nor does the hair H wrap tightly around the brush dowel 62. As the bristle tufts 76 and the projection 73 holding the hair H again comes into contact with the surface to be cleaned, the hair H can be pulled off the bristle tufts 76 and the projection 73 by frictional contact with the surface to be cleaned and the resulting deflection of the bristle tufts 76 and the projection 73. Though the hair H may be returned to the surface, as the vacuum cleaning operation continues, the same hair H may be picked up again by the brushroll 60 and pulled off the brushroll 60 by the suction force of the vacuum cleaner 10. It is also noted that the brushroll 60 may make one or more revolutions before hair H is pulled off the brushroll 60 by suction force or releasing hair back onto the surface to be cleaned.

In one example, the hair wrap angle A2 of the brushroll 60 can be approximately half of the bristle or projection deflection angle A1. Keeping the minor diameter D3 less than the major diameter D1 essentially pulls the bristle tips and the tip of the projection in closer to the shroud surface 74, such that the trim diameter D2 remains slightly larger than the major diameter D1, and hair wrap can be prevented. If the hair wrap angle A2 becomes too shallow, essentially by the major diameter D1 of the shroud surface 74 becoming larger relative to the trim diameter D2, the shroud surface 74 may prevent the bristle tufts 76 and the projection 73 from engaging the surface to be cleaned.

In such an exemplary operation of the brushroll 60 to produce the hair wrap angle A2, the at least one projection 73 can be any suitable elastomeric structure adapted to sweep against the surface to be cleaned, such as by bearing against the surface to be cleaned in instances when the projection 73 is deflected by the surface to be cleaned, non-limiting examples of which include an elastomeric fin, an elastomeric rib, an elastomeric flapper, an elastomeric wiper blade, or an elastomeric blade. Because the at least one projection 73 is formed of a flexible, elastomeric material, the at least one projection 73 can bear against the surface to be cleaned with a greater force than the bristles 72 due to the increased ability of the projection 73 to be deflected by the surface to be cleaned as compared to the bristles 72, resulting in improved performance for sweeping up fine dust relative to a brushroll including only bristles with no projection 73. The inclusion of the projection 73 also further contributes to improving the flexibility of the brushroll 60 for use with a variety of floor types. For example, the bristles 72 may be more effective at removing debris from a carpeted surface, while the projection 73 may be more effective at removing fine dust or dirt, such as from a hard floor surface.

FIGS. 11-15 illustrate a tooling assembly 100 that can be used in forming and producing at least a portion of the brushroll 60 shown in FIGS. 4-10. More specifically, the tooling and a process for forming and ejecting at least a portion of a formed brush dowel 62 from the tooling assembly 100 is illustrated. It will be understood that, for visual simplicity and clarity, FIGS. 11-15 illustrate one tooling assembly 100 that forms one side, or approximately one half, of the brush dowel 62, and that a second tooling assembly 100 can be provided with the other end of the brush dowel 62, such that both ends or halves of the brush dowel 62 can be formed at the same time by separate sets of the tooling assembly 100 positioned opposite one another, although only one half is illustrated herein. In such a case, it will be understood that the description of the structure and operation of the single tooling assembly 100 as illustrated in FIGS. 11-15 would apply simultaneously to the second tooling assembly 100 positioned with the opposite end of the brush dowel 62 at the same time although one side is already illustrated as being fully formed. Alternatively, in another non-limiting example, to produce the brushroll 60, the brush dowel 62 can be formed in a two-part molding process using the tooling assembly 100 to form a portion, such as one end or one half, of the brush dowel 62 at a time, then subsequently forming the second end or half of the brush dowel 62. Regardless of whether the entire brush dowel 62 is formed at once by two tooling assemblies 100 or if the brush dowel 62 is formed one half at a time by a single tooling assembly 100, the use of the tooling assembly 100 for forming the brush dowel 62 allows for the forming of the complex structures of the brush dowel 62 while still ensuring manufacturing quality, such as producing the brush dowel 62 with a uniform wall thickness.

Figure 11:
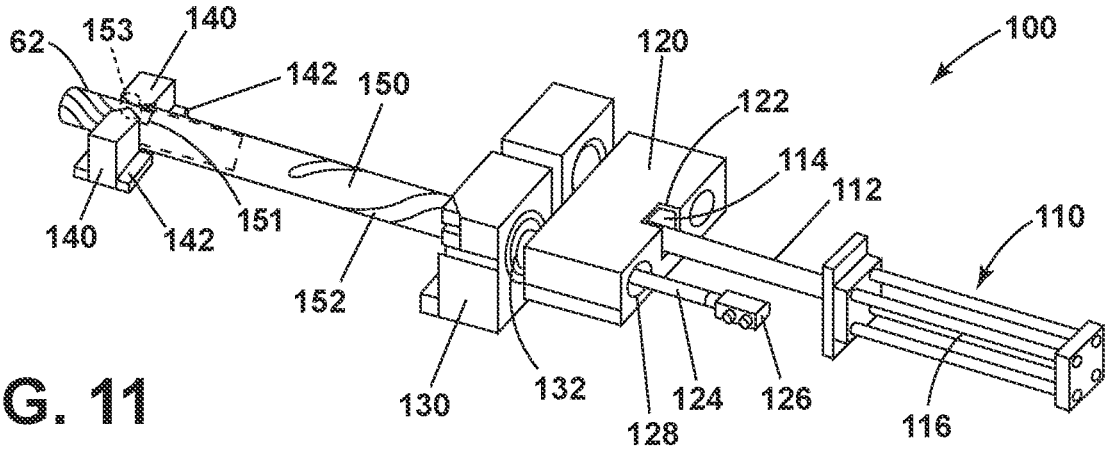
FIG. 11 is a perspective view of a tooling assembly for use in forming the brushroll of FIG. 6, the tooling assembly shown in a first position.
Figure 12:
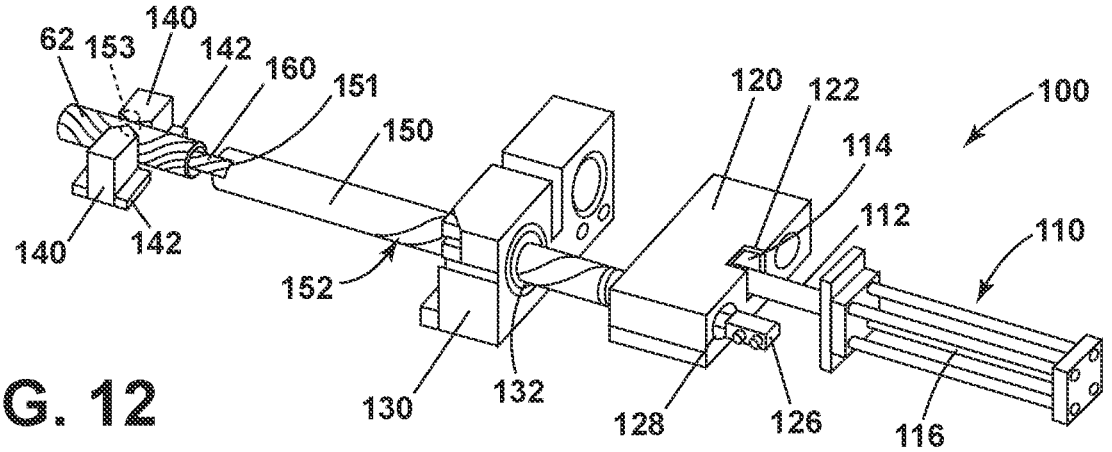
FIG. 12 is a perspective view of the tooling assembly of FIG. 11 shown in a second position.

In FIG. 11, the tooling assembly 100 is shown in a first position wherein the brush dowel 62 is at least partially received within and retained by the tooling assembly 100. In one example, the first position corresponds to a molding position of the tooling assembly 100. The tooling assembly 100 includes an actuating assembly 110, a movable carrier 120, a guide assembly 130, a set of clamps 140, an outer mold 150, and an inner core 160 (FIG. 12). The tooling assembly 100 can be supported on a work surface (not shown) such that the actuating assembly 110, the guide assembly 130, and at least a portion of the set of clamps 140 are coupled or mounted to the work surface to maintain a fixed position relative to the work surface. It will be understood that the visible end of the brush dowel 62 can be located within a second outer mold 150 of a second tooling assembly 100, that is not shown for the sake of visual clarity, and that the visible end of the brush dowel 62 may be actually formed at the same time as the end of the brush dowel 62 shown as within the outer mold 150, or, alternatively, the visible end of the brush dowel 62 can have already been molded and the second side, shown as located interiorly of the outer mold 150, is being formed.

For the sake of clarity, only the formation of one end of the brush dowel 62 will be described for the remainder of the document with it being understood that both sides may be formed simultaneously. To begin, the actuating assembly 110 actuates movement of at least some of the components of the tooling assembly 100 relative to the work surface. The actuating assembly 110 includes a reciprocating piston 112 that is movable between an extended position as shown and a retracted position (FIG. 13) relative to a housing 116. The reciprocating piston 112 includes a piston head 114 at the end of the reciprocating piston 112 opposite the housing 116. In one non-limiting example, the actuating assembly 110 can be provided as a hydraulic cylinder, though it will be understood that any suitable actuating mechanism capable of moving the reciprocating piston 112 between the retracted and extended positions can be used.

The piston head 114 can operably couple the actuating assembly 110 with the movable carrier 120. Specifically, the movable carrier 120 defines a channel 122 within which the piston head 114 can be at least partially received such that the piston head 114 is retained within the channel 122. By way of non-limiting example, the piston head 114 and the channel 122 can couple together via a slide lock mechanism or a bayonet-style fitting, though it will be understood that any suitable coupling can be used such that the piston head 114 is fixed and does not move relative to the movable carrier 120.

The movable carrier 120 further defines a second channel, illustrated herein as a cooling channel 128 for regulating the temperature of the tooling assembly 100 and dissipating heat, which can build up in the tooling assembly 100 during operation. A shaft, illustrated herein as a water line 124 is at least partially received in the cooling channel 128 such that the water line 124 passes through and extends beyond both sides of the movable carrier 120. The water line 124 includes a water line fitting 126 that can be connected to a water supply source (not shown). While the tooling assembly 100 is described herein as including the cooling channel 128, the water line 124, and the water line fitting 126, it will be understood that these examples are not limiting. In another non-limiting example, the cooling channel 128 can be any suitable channel, whether used for cooling or not, the water line 124 can be provided as a simple shaft extending through the channel 128, whether or not it carries water, and the water line fitting 126 can instead be provided as any suitable shaft head and is not limited to a water line fitting 126.

In the illustrated example, the water line 124 is positioned at least partially beside the reciprocating piston 112 and is substantially parallel to the reciprocating piston 112. Further, the water line fitting 126 can be retained at the same end, side, or surface of the movable carrier 120 that the reciprocating piston 112 extends toward and couples with. While the water line 124 is at least partially retained within the cooling channel 128, the water line 124 is not fixed relative to the cooling channel 128, but is rather movable relative thereto, such as by reciprocating, within or through the cooling channel 128. In the first position, or the molding position, of FIG. 11, the water line 124 is in an extended position relative to the movable carrier 120 such that the water line fitting 126 is spaced from the movable carrier 120.

At the end of the cooling channel 128 opposite the water line fitting 126, on the opposite side of the movable carrier 120 from the actuating assembly 110, the outer mold 150 is coupled to the movable carrier 120. Specifically, the outer mold 150 is fixed to the movable carrier 120 such that longitudinal movement of the outer mold 150 relative to the movable carrier 120 is prevented, but the coupling of the outer mold 150 to the movable carrier 120 does permit rotational movement of the outer mold 150 relative to the movable carrier 120. The outer mold 150 couples to the movable carrier 120 at the end of the cooling channel 128 such that the water line 124 extends into and is at least partially received within the outer mold 150 and is co-axial with the outer mold 150. At least a portion of the outer mold 150 defines a threaded outer surface, illustrated herein as a threaded helix drive shaft 152. However, it will be understood that the portion of the outer mold 150 is not limited to the threaded helix drive shaft 152, and could alternatively be provided as any suitable type of threaded outer surface and still fall within the scope of the present disclosure.

Figure 13:
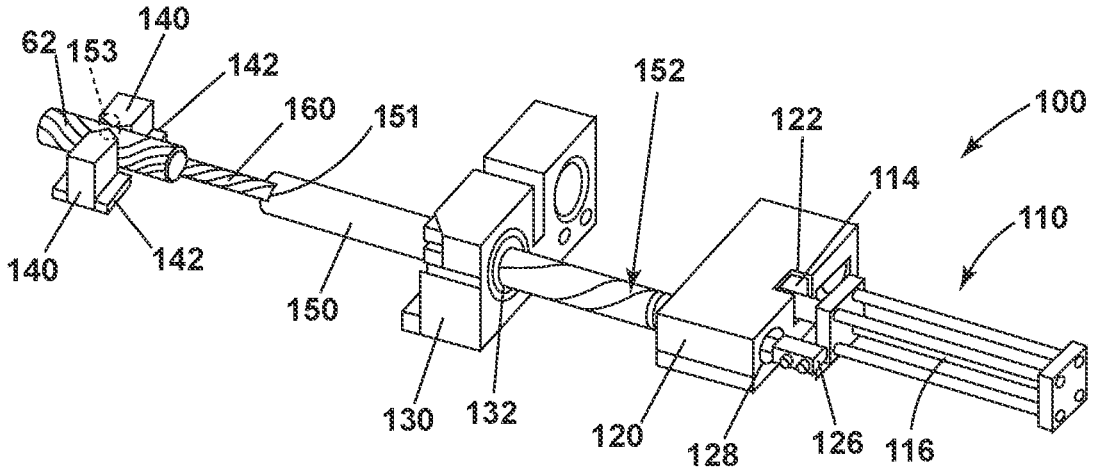
FIG. 13 is a perspective view of the tooling assembly of FIG. 11 shown in a third position.

The guide assembly 130 is fixed relative to the work surface and defines at least one guide channel 132 extending through the guide assembly 130 coaxially with the water line 124 and the outer mold 150. The outer mold 150, and thus also a portion of the water line 124 that is received within the outer mold 150, extends through and is at least partially received within the guide channel 132. The outer mold 150 is rotatably received within the guide channel 132 for rotational movement relative to the guide assembly 130 about an axis of rotation defined by the longitudinal body of the outer mold 150, as well as for reciprocating movement of the outer mold 150 through the guide channel 132 between an extended position as shown and a retracted position (FIG. 13). In the first, molding position as shown, the movable carrier 120 is positioned close to and adjacent the guide assembly 130, though not necessarily abutting the guide assembly 130, and is spaced from the housing 116 of the actuating assembly 110.

The outer mold 150 extends from the movable carrier 120 through the guide channel 132 and toward the set of clamps 140. The outer mold 150 can further define an injection opening 151, which in a non-limiting example can be provided as a notch in the outer mold 150, and further which can be positioned, in one non-limiting example, at the end of the outer mold 150 opposite the movable carrier 120. The injection opening 151 provides a fluid connection through which material for forming the brush dowel 62 can be supplied into the interior defined by the outer mold 150 when the outer mold 150 is in the molding position as shown. By way of non-limiting example, the injection opening 151 can receive a nozzle 153, or other suitable inlet, such as, by way of non-limiting example, a hot drop nozzle location, through which the material to be molded can be supplied into the outer mold 150, such as generally at the midpoint 63 of the brush dowel 62, when the tooling assembly 100 is in the extended position and the outer mold 150 is in the molding position as shown. By way of non-limiting example, the location of the nozzle 153 can be fixed relative to the clamps 140 while the outer mold 150 and the injection opening 151 are movable relative to the clamps 140, such that the nozzle 153 is received within or aligned with the injection opening 151 only when the tooling assembly 100 and the outer mold 150 are in the extended or molding position as shown. It will be further understood that, in the case that the nozzle 153 is provided at the injection opening 151, the nozzle 153 can provide the material for forming the brush dowel 62 immediately at the position of the injection opening 151, or the nozzle 153 or the outer mold 150 can include further structural features to deliver the material to the interior of the outer mold 150, such as to upper, lower, and/or side positions of the midpoint 63 of the outer mold 150.

Figure 14:
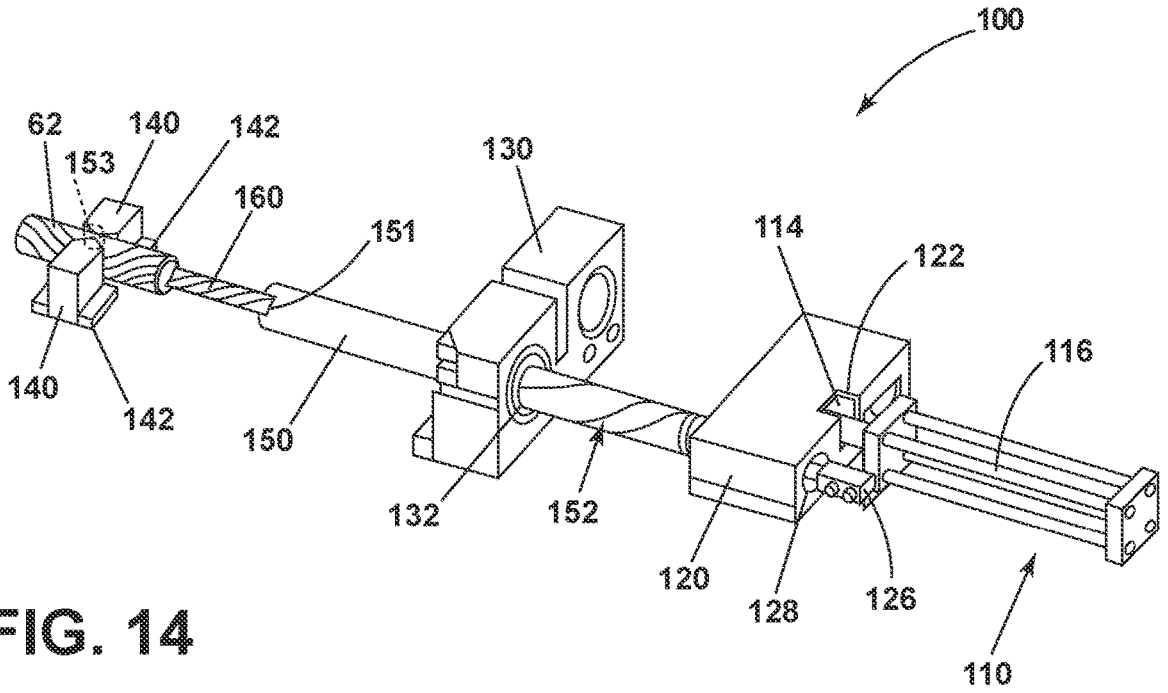
FIG. 14 is a perspective view of the tooling assembly of FIG. 11 shown in a fourth position.

While any suitable number and arrangement of clamps 140 can be provided for retaining the brush dowel 62, in the illustrated example, the set of clamps 140 is provided as a pair of opposing clamps 140. The clamps 140 each include a clamp base 142 that is fixed to the work surface such that the clamp base 142 is not movable relative to the work surface. However, the clamps 140 are movable relative to the clamp bases 142. Specifically, the clamps 140 are movable toward and away from one another between a clamping position as shown and a non-clamping position (FIG. 14). In the clamping position as shown, and corresponding to the first, molding position of the tooling assembly 100, the clamps 140 are moved inwardly toward one another to apply an inward clamping force against the brush dowel 62. In one example, the clamps 140 clamp against and retain the brush dowel 62 at or near the midpoint 63 of the brush dowel 62.

In the first molding position of the tooling assembly 100 as shown, the clamps 140 in the clamping position retain the brush dowel 62 fixed relative to the tooling assembly 100. With the outer mold 150 in the extended position as shown in FIG. 11, the outer mold 150 is fully extended toward the clamps 140. In one example, in the extended position of the outer mold 150, the outer mold 150 extends fully up to the midpoint 63 of the brush dowel 62 where the clamps 140 contact the brush dowel 62, and can even abut the clamps 140 where the clamps 140 contact the brush dowel 62. In this extended position of the outer mold 150, the outer mold 150 at least partially surrounds the brush dowel 62 such that the brush dowel 62 is at least partially received within the outer mold 150, such as, by way of non-limiting example, received within the outer mold 150 up to the midpoint 63 of the brush dowel 62.

The inner core 160 surrounds the water line 124 and is provided at the opposite end of the water line 124 from the water line fitting 126. In one example, the inner core 160 can be provided as an unscrewing inner core 160 that can be used to core out the interior 80 of the brush dowel 62 and to form the interior wall of the brush dowel 62 using only the single unscrewing inner core 160. Though not visible in FIG. 11, it will be understood that, in the molding position of the tooling assembly 100, with the outer mold 150 and the water line 124 in the extended position relative to the clamps 140, the inner core 160 is therefore also provided in an extended position wherein the inner core 160 at least partially extends into the interior 80 of the brush dowel 62, such as, by way of non-limiting example, to an extent that the inner core 160 is received within the interior 80 of the brush dowel 62 up to at least the midpoint 63 of the brush dowel 62. Based on the position of the various components of the tooling assembly 100, the first, molding position of FIG. 11 corresponds to a fully extended and clamping position of the tooling assembly 100.

In FIG. 12, the tooling assembly 100 is illustrated in a second position, corresponding to a partially retracted and clamping position of the tooling assembly 100 and components. In the partially retracted position, the actuating assembly 110 is operated to partially retract the reciprocating piston 112 into the housing 116. Due to the piston head 114 being retained within the channel 122 of the movable carrier 120, movement of the reciprocating piston 112 to the partially retracted position also retracts the movable carrier 120 to a partially retracted position as shown. In the partially retracted position, the movable carrier 120 is spaced away from the guide assembly 130 and has moved slidably along and relative to the water line 124, toward the actuating assembly 110, to the extent that the movable carrier 120, and specifically the cooling channel 128, is brought to bear against the water line fitting 126. Thus, in the partially retracted position of the tooling assembly 100, the water line 124 is in a fully retracted position relative to the movable carrier 120, such that the movable carrier 120 abuts the water line fitting 126, but the water line 124 remains in the extended position relative to the guide assembly 130, the clamps 140, and the brush dowel 62.

The movement of the movable carrier 120 to the partially retracted position relative to the guide assembly 130 in turn retracts the outer mold 150 to the partially retracted position, wherein a portion of the outer mold 150 has passed through the guide channel 132, toward the actuating assembly 110. As the outer mold 150 passes through the guide channel 132 toward the actuating assembly 110, the outer mold 150 is also simultaneously rotated relative to the movable carrier 120 and relative to the guide assembly 130. In one example, the guide channel 132 can define a threaded surface that is complementary to the threaded helix drive shaft 152 of the outer mold 150, such that the contact and interaction between the guide channel 132 and the threaded helix drive shaft 152 as the outer mold 150 passes through the guide channel 132, moving toward the actuating assembly 110, causes rotation of the outer mold 150 relative to the guide assembly 130 as the outer mold 150 moves through the guide assembly 130.

With the outer mold 150 moved to the partially retracted position as shown, the outer mold 150 is partially retracted away from the clamps 140 and from the brush dowel 62, such that the outer mold 150 no longer surrounds any portion of the brush dowel 62 and the brush dowel 62 is no longer received within the outer mold 150. With the outer mold 150 removed from the brush dowel 62, the inner core 160 can be seen in the extended position relative to the brush dowel 62. As the outer mold 150 moved to the partially retracted position, the outer mold 150 moved both longitudinally and rotationally relative to the water line 124. However, as the movable carrier 120 is just brought to abut the water line fitting 126 in the partially retracted position, the water line 124 is not yet moved by the movable carrier 120, and thus remains in the extended position relative to the guide assembly 130, the clamps 140, and the brush dowel 62. Therefore, the inner core 160, which is carried by the water line 124, likewise remains in the extended position relative to the guide assembly 130, the clamps 140, and the brush dowel 62. The clamps 140 remain in the clamping position relative to the brush dowel 62.

In FIG. 13, the tooling assembly 100 is illustrated in a third position, corresponding to a fully retracted and clamping position of the tooling assembly 100 and components. In the fully retracted position, the actuating assembly 110 is further operated to fully retract the reciprocating piston 112 into the housing 116. Again, due to the piston head 114 being retained within the channel 122 of the movable carrier 120, movement of the reciprocating piston 112 to the fully retracted position also retracts the movable carrier 120 to the fully retracted position as shown. In the fully retracted position, the movable carrier 120 is fully spaced away from the guide assembly 130. Because the movable carrier 120 was previously brought to bear against the water line fitting 126 in the partially retracted position, further movement of the movable carrier 120 toward the actuating assembly 110, and from the partially retracted position to the fully retracted position, in turn retracts the water line 124 from the extended position to the fully retracted position relative to the guide assembly 130, the clamps 140, and the brush dowel 62. The water line 124 remains in the fully retracted position relative to the movable carrier 120.

Likewise, the further movement of the movable carrier 120 toward the actuating assembly 110, and from the partially retracted position to the fully retracted position, in turn also retracts the outer mold 150 to the fully retracted position, wherein yet a further portion of the outer mold 150 has passed through the guide channel 132, toward the actuating assembly 110. The further movement of the outer mold 150 passing through the guide channel 132 from the partially retracted position to the fully retracted position correspondingly causes further rotation of the outer mold 150 relative to the movable carrier 120 and relative to the guide assembly 130 as described previously.

With the outer mold 150 moved to the fully retracted position, the outer mold 150 is spaced away from the clamps 140 and from the brush dowel 62, exposing more of the inner core 160 to view. As the inner core 160 is carried by the water line 124, the movement of the water line 124 to the fully retracted position relative to the guide assembly 130, the clamps 140, and the brush dowel 62 in turn retracts the inner core 160 from the extended position to the fully retracted position relative to the guide assembly 130, the clamps 140, and the brush dowel 62. In the fully retracted position, the inner core 160 is fully withdrawn and removed from the interior 80 of the brush dowel 62 such that no portion of the inner core 160 remains received within the interior 80 of the brush dowel 62. Thus, with the tooling assembly 100 in the fully retracted and clamping position, the clamps 140 are the only component of the tooling assembly 100 remaining in contact with and retaining the brush dowel 62. The clamps 140 remain in the clamping position relative to the brush dowel 62.

In FIG. 14, the tooling assembly 100 is illustrated in a fourth position, corresponding to a fully retracted and non-clamping position of the tooling assembly 100 and components. With the components of the tooling assembly 100 already moved to the fully retracted position as described above with respect to FIG. 13, all of the components of the tooling assembly 100 except for the clamps 140 have been removed from contact or engagement with the brush dowel 62. Movement of the clamps 140 from the clamping position to the non-clamping position as shown will therefore allow for the completed, molded brush dowel 62 to be removed from the tooling assembly 100 to be used to further produce the brushroll 60. To move the clamps 140 to the non-clamping position, the clamps 140 can be moved away from one another, such as by laterally outward sliding movement of the clamps 140 along and relative to the clamp bases 142, toward the opposing outer edges of the clamp bases 142. With the clamps 140 in the non-clamping position, the clamps 140 no longer contact the brush dowel 62 nor apply an inward clamping force against the brush dowel 62, permitting the brush dowel 62 to be fully removed from the tooling assembly 100.

Figure 15:
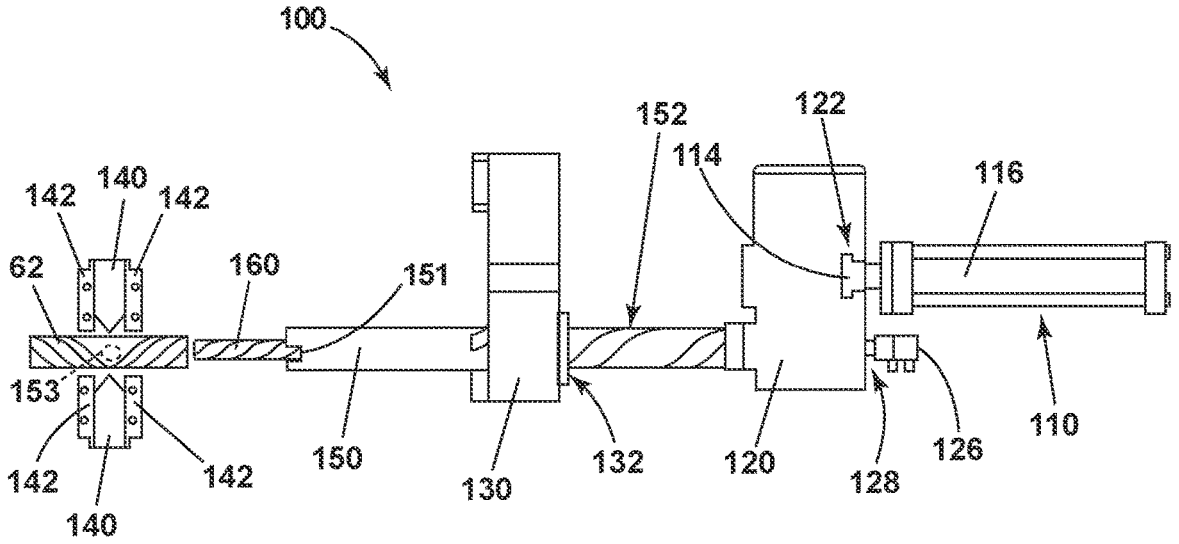
FIG. 15 is a top view of the tooling assembly of FIG. 14 in the fourth position.

In the top view of FIG. 15, with the tooling assembly 100 remaining in the fully retracted and non-clamping position as in FIG. 14, the non-clamping position of the clamps 140 is better seen. The clamps 140 are moved outwardly toward and past the opposing outer edges of the clamp bases 142. Further, the clamps 140 are moved outwardly away from the brush dowel 62 such that the clamps 140 no longer clamp or contact the brush dowel 62, allowing for removal of the brush dowel 62 from the tooling assembly 100.

Turning to the operation of the tooling assembly 100 to form the brush dowel 62 for producing the brushroll 60, the single, one side of the tooling assembly 100 as illustrated herein as configured to mold one half of the brush dowel 62 in a molding operation process as described, and with the other half of the brush dowel 62 either being formed concurrently by a second, not pictured tooling assembly 100 or being formed previously or subsequently by the same tooling assembly 100, as previously discussed. Specifically, each single tooling assembly 100 can mold precisely one half of the longitudinal length of the brush dowel 62, up to the midpoint 63 of the brush dowel 62. In one non-limiting example, when the first half of the brush dowel 62 has been molded using the tooling assembly 100, the brush dowel 62 can then be rotated such that the other half of the brush dowel 62 can then be molded using the same tooling assembly 100, such that the outer contour of the brush dowel 62 is formed using a two-part or two-step molding process. In another non-limiting example, two tooling assemblies 100 can be provided, positioned opposite one another about the set of clamps 140, such that the brush dowel 62 can be clamped within the clamps 140 for molding of both halves of the brush dowel 62 without needing to remove the brush dowel 62 from the clamps 140 or rotate the brush dowel 62 within the clamps 140. In such an example, the first and second halves of the brush dowel 62 can be molded by the first and second tooling assemblies 100 either one after the other, or even concurrently while the brush dowel 62 is retained by the set of clamps 140.

Whether both halves of the brush dowel 62 are formed concurrently or in sequence, the material for forming the brush dowel 62 can be provided to the outer mold 150 in any suitable manner, such as by injection to the outer mold 150 from the nozzle 153 through either the injection opening 151 or any other suitable opening provided with the outer mold 150. The material for forming the brush dowel 62 can be provided to flow freely into the outer mold 150 after being delivered from the nozzle 153 through the injection opening 151, or the material provided from the nozzle 153 and through the injection opening 151 can be directed to a specific point or points within the outer mold 150 and spaced from the nozzle 153 and the injection opening 151. In one such non-limiting example, either the interior of the outer mold 150 or the nozzle 153 positioned adjacent the injection opening 151 in the molding position of FIG. 11 can define at least one conduit extending within the outer mold 150 to provide the material for forming the brush dowel 62 further into the outer mold 150, such as by providing the material to opposing sides of the brush dowel 62 within the outer mold 150. Regardless of whether the material is provided only from the nozzle 153 to the injection opening 151 or further within the outer mold 150, by way of further non-limiting example, the material for forming the brush dowel 62 can be provided to the outer mold 150 either as the outer mold 150 is rotatably withdrawn away from the clamps 140 or before the outer mold 150 is rotatably withdrawn away from the clamps 140, when the outer mold 150 is stationary.

Other manufacturing methods can also be used to produce the brushroll 60 shown in FIGS. 4-10, such as, by way of non-limiting example, by the use of a two-part mold to form the outer contour of the brush dowel 62. However, it is noted that, in order to form the brushroll 60 in a two-part mold, the bristle supports 70, the sweeper supports 71, and the shroud surfaces 74 may be required to extend only 180 degrees or less along the length of the brush dowel 62 in order to be in the line of draw.

The completed, formed brush dowel 62, whether formed by the use of the tooling assembly 100 or by another manufacturing method, is then used to produce the brushroll 60. In one example, the bristle holes 84 or the sweeper holes 85 can be formed in the brush dowel 62 by drilling into the brush dowel 62 after molding, or can be integrally molded with the brush dowel 62. The bristle tufts 76 can be assembled with the brush dowel 62 by pressing bristles 72 into the bristle holes 84 and securing the bristles 72 using a fastener (not shown), such as, but not limited to, a staple, wedge, or anchor. Likewise, the projections 73 can be assembled with the brush dowel 62 by pressing a portion of the projections 73 into the sweeper holes 85 and securing the projections 73 using a fastener (not shown), such as, but not limited to, a staple, wedge, or anchor.

The components of the brushroll 60 can be formed of a variety of suitable materials to provide the desired characteristics. By way of non-limiting example, the brush dowel 62 can include a polymeric material, such as polypropylene, acrylonitrile butadiene styrene (ABS), or styrene. Further by way of non-limiting example, the bristles 72 can include a polymeric material, such as nylon or polyester, for example, which allows the bristles 72 to flex and deflect when brought into contact with a surface to be cleaned during normal operation. In one non-limiting example, the diameter of each individual bristle can be 0.30 millimeters. Likewise, the projections 73 can include an elastomeric material or a polymeric material, such as nylon or polyester, for example, to allow the projections 73 to flex and deflect when brought into contact with a surface to be cleaned during normal operation, which results in more effective removal of debris. In one aspect of the present disclosure, by way of non-limiting example, the projections 73 can comprise a strip brush or a continuous strip of fine bristles having a diameter less than the diameter of the bristles 72. Further by way of non-limiting example, in such a case, the projections 73 can comprise a strip brush with individual bristles having a diameter of 0.15 millimeters and a length of 17 millimeters.

The vacuum cleaner 10 and brushroll 60 disclosed herein provide an improved brushroll design which addresses the problem of hair wrap and tangling about the brushroll, as well as providing an improved brushroll and vacuum cleaner for ease and effectiveness of use on multiple types of floors or surfaces to be cleaned. Aspects of the present disclosure include brushroll designs in which the hair wrap angle A2 is less than or equal to the deflection angle A1 (in other words, where A2≤A1). Such brushrolls release hair that is not pulled off the brushroll by the suction force of the vacuum cleaner back on to the surface to be cleaned, rather than tightly wrapping the hair on the brushroll. These brushrolls provide the opportunity to prevent or greatly reduce the amount of hair wrap during operation. Other aspects of the present disclosure include brushroll designs that provide both bristles as well as elastomeric sweeping elements with the brushroll for improved debris removal and cleaning performance on both soft floors like carpeting and hard floors, such as wood or linoleum.

Still other aspects of the present disclosure include a tooling assembly for improved ease of forming an improved brushroll design, as well as methods and processes for forming such an improved brushroll using the tooling assembly. In another example, the vacuum cleaner can include a light assembly that can also operate as a status indicator system for the vacuum cleaner and its various components. In yet another example, the vacuum cleaner can include an ultrasonic floor type sensor to detect a type of floor to be cleaned and to automatically adjust the operation of the vacuum cleaner accordingly, such as to adjust the rotational speed of the brushroll based on whether the floor is carpeted or is a hard floor in order to improve cleaning performance and reduce the amount of debris scatter that can occur when the brushroll rotation speed is not optimized for the floor type.

To the extent not already described, the different features and structures of the various aspects of the disclosure, may be used in combination with each other as desired, or may be used separately. That one surface cleaning apparatus is illustrated herein as having all of these features does not mean that all of these features must be used in combination, but rather is done so here for brevity of description. Furthermore, while the surface cleaning apparatus shown herein has an upright configuration, the surface cleaning apparatus can be configured as a canister or portable unit. For example, in a canister arrangement, foot components such as the suction nozzle and brushroll can be provided on a cleaning head coupled with a canister unit. Still further, the surface cleaning apparatus can additionally have steam delivery capability. Thus, the various features of the different aspects may be mixed and matched in various vacuum cleaner configurations as desired to form new aspects, whether or not the new aspects are expressly described.

While the aspects of the present disclosure have been specifically described in connection with certain specific aspects thereof, it is to be understood that this is by way of illustration and not of limitation. Reasonable variation and modification are possible with the scope of the foregoing disclosure and drawings without departing from the spirit of the present disclosure, which is defined in the appended claims. Hence, specific dimensions and other physical characteristics relating to the aspects disclosed herein are not to be considered as limiting, unless the claims expressly state otherwise.

What is claimed is:

1. A vacuum cleaner comprising:

a base comprising an agitator chamber and a suction nozzle opening in fluid communication with the agitator chamber;

an upright body pivotally mounted to the base and comprising a main support section supporting a cyclonic collection system comprising a cyclone separator;

a suction source in fluid communication with the cyclonic collection system; and a brushroll positioned within the agitator chamber for rotational movement about a central rotational axis, the brushroll comprising:

a brush dowel configured to be mounted for rotation about the central rotational axis, which extends longitudinally through the brush dowel, and comprising:

a first bristle support defining a first bristle mounting surface comprising a first trough-shaped concave bristle surface and first bristle support platforms recessed inwardly from the first concave bristle surface toward the central rotational axis, a second bristle support, opposed from the first bristle support, the second bristle support defining a second bristle mounting surface comprising a second trough-shaped concave bristle surface and second bristle support platforms recessed inwardly from the second concave bristle surface toward the central rotational axis, a first sweeper support interposed between the opposing bristle supports and defining a first sweeper mounting surface comprising a first trough-shaped concave sweeper surface and first sweeper support platforms recessed inwardly from the first concave sweeper surface toward the central rotational axis, a second sweeper support, opposed from the first sweeper support, the second sweeper support defining a second sweeper mounting surface comprising a second trough-shaped concave sweeper surface and second sweeper support platforms recessed inwardly from the second concave sweeper surface toward the central rotational axis, and a shroud surface comprising a leading pair of opposing convex surfaces each extending between outside corners and positioned between one of the opposing bristle supports and one of the interposed opposing sweeper supports and a trailing pair of opposing convex surfaces extending between outside corners and interposed between the leading pair of opposing convex surfaces such that each of the convex surfaces are located between one of the opposing bristle supports and one of the interposed opposing sweeper supports, and a plurality of discrete bristle tufts provided in the first bristle support platforms and the second bristle support platforms, a first projection comprising a first elastomeric sweeper fastened to the first sweeper support at the first sweeper support platforms and projecting through the first sweeper mounting surface; and a second projection comprising a second elastomeric sweeper fastened to the second sweeper support at the second sweeper support platforms and projecting through the second sweeper mounting surface;

wherein the concave bristle and sweeper surfaces are recessed radially inward toward the central rotational axis from the convex surfaces.

2. The vacuum cleaner of claim 1 wherein the first and second elastomeric sweepers each comprise an elastomeric wiper blade.

3. The vacuum cleaner of claim 1 wherein the first and second bristle supports each extend in a single chevron shape along the brush dowel relative to the central rotational axis and multiple bristle tufts are fastened to each of the first and second bristle supports and arranged in a single chevron-shaped row on the first and second bristle mounting surfaces defined by the first and second sweeper supports.

4. The vacuum cleaner of claim 3 wherein the first and second sweeper supports each extend in a single chevron shape along the brush dowel relative to the central rotational axis and the first and second projections fastened to the first and second sweeper supports are each provided in a single chevron shape on the first and second sweeper mounting surfaces defined by the first and second sweeper supports.

5. The vacuum cleaner of claim 1 further comprising a floor type sensor configured to provide a sensor output indicative of a type of floor beneath the vacuum cleaner.

6. The vacuum cleaner of claim 5 wherein the floor type sensor comprises an ultrasonic floor type sensor.

7. The vacuum cleaner of claim 5 wherein the sensor output indicative of the type of floor determines a speed at which the brush dowel is rotated about the central rotational axis.

8. The vacuum cleaner of claim 7 wherein the speed at which the brush dowel is rotated when the sensor output is indicative of a hard floor type is lower than the speed at which the brush dowel is rotated when the sensor output is indicative of a carpeted floor type.

9. The vacuum cleaner of claim 1 wherein the vacuum cleaner is one of an upright-type vacuum cleaner, a canister-type vacuum cleaner, a stick vacuum cleaner, an autonomous vacuum cleaner, or a hand-held vacuum cleaner.

10. The vacuum cleaner of claim 1 wherein the first and second trough-shaped concave bristle and sweeper surfaces comprise concave curved bristle and sweeper surfaces.

11. The vacuum cleaner of claim 1 wherein the leading pair and the trailing pair of convex surfaces comprise convex curved surfaces.

12. The vacuum cleaner of claim 11 wherein the leading pair and the trailing pair of convex surfaces have the same convex curved shape.

13. A vacuum cleaner comprising:

a base comprising an agitator chamber and a suction nozzle opening in fluid communication with the agitator chamber;

an upright body pivotally mounted to the base and comprising a main support section supporting a cyclonic collection system comprising a cyclone separator;

a suction source in fluid communication with the cyclonic collection system; and a brushroll positioned within the agitator chamber for rotational movement about a central rotational axis, the brushroll comprising:

a brush dowel configured to be mounted for rotation about the central rotational axis, which extends longitudinally through the brush dowel, and comprising:

opposing bristle supports defining first mounting surfaces comprising concave curved surfaces and bristle support platforms, opposing sweeper supports interposed between the opposing bristle supports and defining second mounting surfaces comprising concave curved surfaces and sweeper support platforms, and a shroud surface comprising opposing convex curved surfaces each extending between outside corners and positioned between one of the opposing bristle supports and one of the interposed opposing sweeper supports such that both outside corners of each convex curved surface are located between the one of the opposing bristle supports and the one of the interposed opposing sweeper supports, wherein the concave curved surfaces are recessed inwardly toward the central rotational axis, below the shroud surface, and extend between the outside corners such that the first and second mounting surfaces intersect the convex curved surfaces at the outside corners, and a plurality of bristle tufts fastened to each of the opposing bristle supports at the bristle support platforms and projecting through one of the first mounting surfaces between the outside corners; and a projection fastened to each of the interposed opposing sweeper supports at the sweeper support platforms and projecting through one of the second mounting surfaces between the outside corners;

wherein the opposing bristle supports each extend in a single chevron shape along the brush dowel relative to the central rotational axis and multiple bristle tufts are fastened to each bristle support and arranged in a single chevron-shaped row on the first mounting surfaces, and wherein the interposed opposing sweeper supports each extend in a single chevron shape along the brush dowel relative to the central rotational axis and the projections fastened to each interposed sweeper support are each provided in a single chevron shape on the second mounting surfaces.

14. The vacuum cleaner of claim 13 further comprising a floor type sensor configured to provide a sensor output indicative of a type of floor beneath the vacuum cleaner.

15. The vacuum cleaner of claim 14 wherein the sensor output indicative of the type of floor determines a speed at which the brush dowel is rotated about the central rotational axis.

16. The vacuum cleaner of claim 15 wherein the floor type sensor comprises an ultrasonic floor type sensor.

17. The vacuum cleaner of claim 16 wherein the speed at which the brush dowel is rotated when the sensor output is indicative of a hard floor type is lower than the speed at which the brush dowel is rotated when the sensor output is indicative of a carpeted floor type.

18. The vacuum cleaner of claim 17 wherein the speed at which the brush dowel is rotated when the sensor output is indicative of the hard floor type is a non-zero speed.

19. A brushroll for a vacuum cleaner, comprising:

a brush dowel configured to be mounted for rotation about a central rotational axis, which extends longitudinally through the brush dowel, and comprising:

opposing bristle supports defining first mounting surfaces comprising concave curved surfaces and bristle support platforms recessed inwardly toward the central rotational axis, below the concave curved surfaces, opposing sweeper supports interposed between the opposing bristle supports and defining second mounting surfaces comprising concave curved surfaces and sweeper support platforms recessed inwardly toward the central rotational axis, below the concave curved surfaces, and a shroud surface comprising opposing convex curved surfaces each extending between outside corners and positioned between one of the opposing bristle supports and one of the interposed opposing sweeper supports such that both outside corners of each convex curved surface are located between the one of the opposing bristle supports and the one of the interposed opposing sweeper supports, and a plurality of bristle tufts fastened to each of the opposing bristle supports at the bristle support platforms and projecting through one of the first mounting surfaces; and a projection comprising an elastomeric sweeper fastened to each of the interposed opposing sweeper supports at the sweeper support platforms and projecting through one of the second mounting surfaces;

wherein the concave curved surfaces are recessed inwardly toward the central rotational axis, below the shroud surface, and extend between the outside corners such that the first and second mounting surfaces intersect the convex curved surfaces at the outside corners and the plurality of bristle tufts and the projections project through the concave curved surfaces between the outside corners.

* * * * *